US007749113B2

(12) United States Patent
Morrow et al.

(10) Patent No.: US 7,749,113 B2
(45) **Date of Patent: *Jul. 6, 2010**

(54) LACROSSE HEAD WITH INCREASED STRENGTH AND PLAYABILITY CHARACTERISTICS

(75) Inventors: David Morrow, Metamora, MI (US); Jesse Hubbard, New York, NY (US); Andrew Maliszewski, Dearborn Heights, MI (US); Matthew Winningham, Royal Oak, MI (US); Richard Janisse, Windsor (CA)

(73) Assignee: Warrior Sports, Inc., Warren, MI (US)

( * ) Notice: Subject to any disclaimer, the term of this patent is extended or adjusted under 35 U.S.C. 154(b) by 298 days.

This patent is subject to a terminal disclaimer.

(21) Appl. No.: 11/753,959

(22) Filed: May 25, 2007

(65) Prior Publication Data

US 2008/0026884 A1 Jan. 31, 2008

Related U.S. Application Data

(63) Continuation-in-part of application No. 10/437,842, filed on May 14, 2003, now Pat. No. 7,258,634, and a continuation-in-part of application No. 10/437,542, filed on May 14, 2003, now Pat. No. 7,226,374.

(51) Int. Cl.
*A63B 59/02* (2006.01)
*A63B 65/12* (2006.01)

(52) U.S. Cl. ..... 473/513; 473/512; 473/505; D21/724

(58) Field of Classification Search ..... 473/513, 473/505, 512; D21/724
See application file for complete search history.

(56) References Cited

U.S. PATENT DOCUMENTS

| | | | |
|---|---|---|---|
| 236,045 | A | 12/1880 | Kreutzer |
| 1,555,164 | A | 9/1925 | Schwartz |
| 1,611,858 | A | 12/1926 | Middlekauff |
| 1,750,644 | A | 3/1930 | Norton |
| 2,274,788 | A | 3/1942 | Hatton |

(Continued)

FOREIGN PATENT DOCUMENTS

| | | |
|---|---|---|
| GB | 0424742 | 2/1935 |
| JP | 2000-61005 | 2/2000 |

OTHER PUBLICATIONS

Web Page Download, Devco Design and Development, 1998, http://www.devco-design.com/mi-mold.htm, 3 pp.

*Primary Examiner*—Gene Kim
*Assistant Examiner*—M Chambers
(74) *Attorney, Agent, or Firm*—Warner Norcross & Judd LLP

(57) ABSTRACT

A lacrosse head that is constructed of multiple different materials or components having different strength characteristics with the stronger materials or components located in predetermined locations to provide increased resistance to flex and/or breakage in those areas while allowing desired flex in some areas. The lacrosse head is co-formed of the multiple different materials by such processes as injection molding, gas assist injection molding, compression molding, thermal forming and extrusion such that the multiple different materials are coupled to form a single integrated structure.

8 Claims, 12 Drawing Sheets

U.S. PATENT DOCUMENTS 2,902,072 A 9/1959 Reuter
3,402,385 A * 9/1968 Feinberg ..... 439/606
3,479,030 A 11/1969 Merola
3,701,374 A 10/1972 McGillvary
3,910,578 A 10/1975 Brine, Jr.
4,098,508 A * 7/1978 Gandy ..... 473/513
4,119,313 A 10/1978 Popplewell et al.
4,310,368 A * 1/1982 Urquiaga ..... 156/148
4,374,590 A * 2/1983 Everlith et al. ..... 473/513
5,054,790 A 10/1991 Brine et al.
5,568,925 A 10/1996 Morrow et al.
5,662,484 A * 9/1997 Blanche ..... 439/106
5,685,791 A 11/1997 Feeney
5,964,622 A * 10/1999 Ishikawa et al. ..... 439/606
6,066,056 A 5/2000 Morrow
6,190,212 B1 * 2/2001 Brown et al. ..... 439/736
6,676,547 B1 1/2004 Morrow et al.
6,723,134 B2 4/2004 Tucker, Sr.
7,238,128 B1 * 7/2007 Filice et al. ..... 473/513
7,258,634 B2 8/2007 Morrow et al.
7,226,374 B2 6/2008 Morrow et al.

* cited by examiner

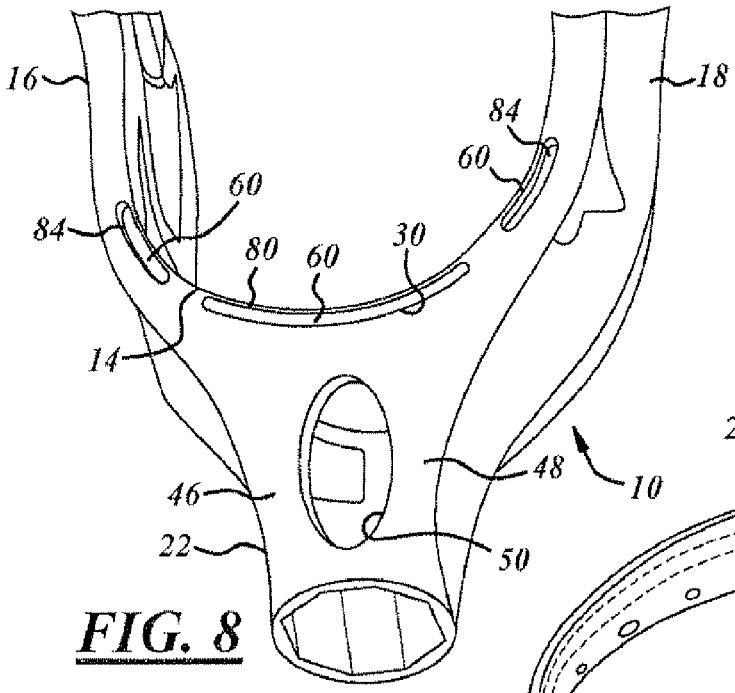
FIG. 8
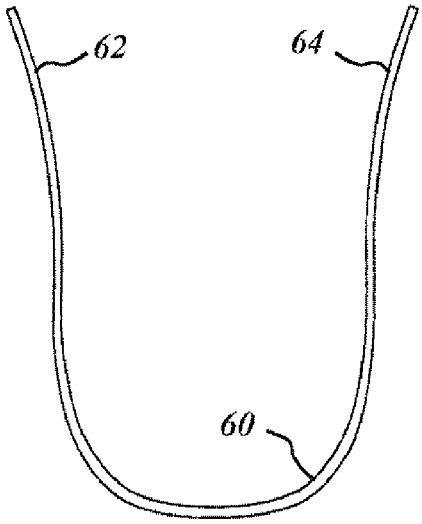
FIG. 9
FIG. 10
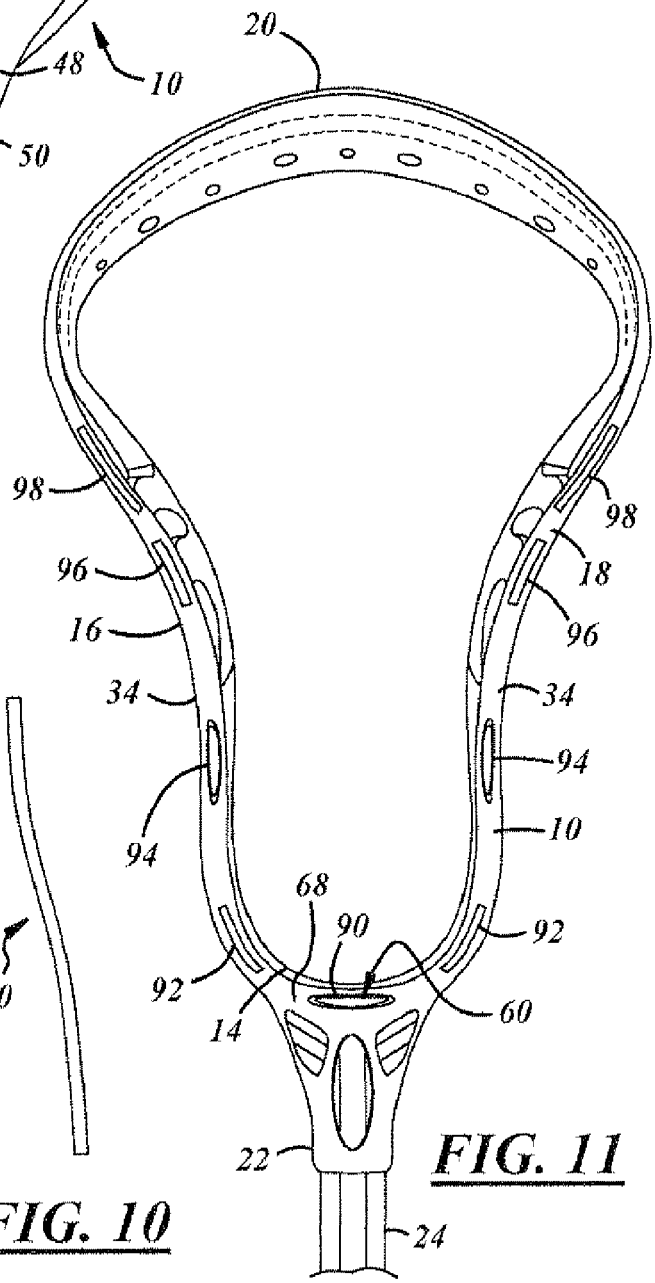
FIG. 11

LACROSSE HEAD WITH INCREASED STRENGTH AND PLAYABILITY CHARACTERISTICS

CROSS-REFERENCE TO RELATED APPLICATIONS

The present application is a continuation-in-part of U.S. patent application Ser. No. 10/437,842 entitled "Reinforced Lacrosse Head," filed on May 14, 2003, which claims priority to U.S. Provisional Application Ser. No. 60/380,547, entitled "Stiffening Ribs For A Lacrosse Head," filed May 14, 2002, the disclosures of which are hereby incorporated by reference as though set forth fully herein. The present application is also a continuation-in-part of U.S. patent application Ser. No. 10/437,542, entitled "Lacrosse Head And Method Of Forming Same," filed on May 14, 2003, which claims priority to U.S. Provisional Application Ser. No. 60/418,922, entitled "Lacrosse Head And Method Of Forming Same," filed on Oct. 15, 2002.

TECHNICAL FIELD

The present invention relates generally to a lacrosse head for attachment to a lacrosse handle. More particularly, the present invention relates to a lacrosse head that is constructed of multiple different components or materials to yield both increased strength and performance characteristics.

BACKGROUND OF THE INVENTION

Early lacrosse stick architecture included wooden frames having a typical construction consisting of a solid handle, one sidewall, and a scoop all formed as a single continuous structure. Drawbacks of these wooden frames include poor resistance to water damage, susceptibility to fractures, relatively high weight, and substantial manufacturing costs due to the labor required to manually form the lacrosse stick into the desired shape.

Subsequent developments in lacrosse head structures included employing plastic (polymeric) injection molding to form a single integral frame having a solid base or ballstop, a solid scoop, and a pair of solid sidewalls all interconnected. See e.g. U.S. Pat. No. 3,507,495. These plastic lacrosse heads provided increased stiffness and decreased weight as compared to the prior wooden lacrosse sticks. They were also easier and less expensive to manufacture than the prior wooden sticks because they could be formed through automated processes like injection molding. Additionally, the plastic heads were formed independently from the lacrosse handles so that the head or handle could be replaced separately from the other if either was damaged or broken. The majority of these lacrosse heads were molded of a polyamide material such as Nylon 6,6.

Subsequent developments involved forming these plastic lacrosse heads with openings in the sidewalls ("open sidewalls"). The lacrosse heads with open sidewalls are generally lighter in weight than lacrosse heads with solid sidewalls and typically provide more flex due to the absence of supporting structure in the sidewall. This decrease in weight is beneficial because it can improve the handling characteristics of these lacrosse heads and also decrease the material costs and the manufacturing costs associated with the forming thereof. However, the absence of material from the sidewalls can also cause these lacrosse heads to have insufficient resistance to breakage or fracture. Additionally, the absence of material from these sidewalls can cause these heads to exhibit undue flex, which provides disadvantages during play.

To prevent premature breakage or fracturing of these open sidewall lacrosse heads, stiffening structures, such as ribs, have been integrally molded into the sidewalls or other portions of the head, including the throat portion. These stiffening ribs are intended to provide the lacrosse heads with sufficient stiffness or reinforcement in order to prevent breakage or fracturing as well as to minimize the flexibility of the heads. These stiffening ribs are formed of the same polymeric materials as the other portions of the head and are also formed during the same manufacturing process as the rest of the head. A drawback, however, of these stiffening ribs is that they typically increase the weight of the lacrosse head. For this reason, the stiffening ribs may increase the material costs as well as the manufacturing costs of the lacrosse head. In view of the foregoing, a person of ordinary skill in the art would understand that the design of a lacrosse head requires a balance between stiffness and weight in order to provide a head with optimum playability and performance. The inclusion of stiffening ribs in these prior heads, including open sidewall lacrosse heads, does not provide adequate stiffness under all circumstances.

For example, it is a common problem with these prior plastic lacrosse heads that when used, such as during warm or hot weather or on synthetic fields, they can become hot. In these conditions, the polymeric material from which the heads are constructed becomes soft and the strength may be, at least partially, compromised. At a minimum, the stiffness is significantly reduced which typically yields undesirable flexibility which negatively impacts the playability of the head. It is therefore desirable to provide a lacrosse stick that is resistant to the effects of heat or at least strengthened, such that properties of the stick are not compromised due to the heat typically present during game-play. Further, even in cool or normal temperatures, current plastic lacrosse heads can exhibit undue or undesirable flex that can significantly affect their playability. This flex of the head includes both forward flex and side-to-side flex and can result from a variety of normal actions, including contact with the ground, another stick or player. Additionally, current heads can exhibit undesirable flex when a player holding the stick is checked. In fact, in certain circumstances, this flex can cause the head to lose its shape or become deformed for short periods of time such that it is unusable. Thus, it is also desirable to provide a lacrosse head that has increased strength and/or playability under any circumstances.

It is further desirable to provide a lacrosse head that is sufficiently stiff to resist breakage, yet also has a relatively light weight for improving handling characteristics, decreasing material costs, and decreasing manufacturing costs associated therewith. It is also desirable to provide a lacrosse head that provides decreased flex and provides increased performance features.

SUMMARY OF THE INVENTION

It is therefore an advantage of the present invention to provide a lacrosse head that minimizes the undesirable flex that is present in current heads.

It is another advantage of the present invention to provide a lacrosse head that can be tuned to provide a variety of different playability characteristics as desired.

It is still another advantage of the present invention to provide a lacrosse head that has increased strength and provides improved playability and performance as compared to existing lacrosse heads due in part to its ability to maintain its shape under extreme conditions and forces.

It is yet another advantage of the present invention to provide a lacrosse head that has a reinforcing material or component in selected locations to minimize breakage and/or undesirable flex.

It is still yet another advantage of the present invention to provide a lacrosse head that is constructed of multiple different materials or components having varying strength characteristics.

It is a related advantage of the present invention to provide a lacrosse head that is constructed of multiple different materials or components having different strength characteristics with the stronger materials or components located in predetermined locations to provide increased resistance to flex and/or breakage in those areas while allowing desired flex in some areas.

It is still a further advantage of the present invention to provide a method of forming a lacrosse head from multiple materials or components having varying properties that can be tuned by positioning the materials in at least one predetermined location to vary the strength, weight, flexibility and other characteristics of the head.

In accordance with the above and the other advantages of the present invention, a lacrosse head having increased strength and performance is provided. The lacrosse head includes an open frame element having a ballstop portion, a pair of opposing sidewall portions, and a scoop portion. The open frame also includes a throat portion extending rearwardly from the ballstop portion for attachment to a handle portion. The head is constructed of a plurality of different separate polymeric, non-polymeric and/or composite materials or components. At least one of the materials or components has greater strength than one of the other materials or components. The plurality of materials or components with greater strength are located on or in the head during the manufacture in predetermined locations in order to provide increased strength at certain portions of the head and improved playability.

Other advantages and features of the present invention will become apparent when viewed in light of the detailed description and preferred embodiment when taken in conjunction with the attached drawings and claims.

BRIEF DESCRIPTION OF THE DRAWINGS

FIG. 8 is a partial perspective view of the rear portion of a lacrosse head in accordance with another embodiment of the present invention;

FIG. 9 is a schematic illustration from the top of a reinforcing member for a lacrosse head in accordance with one embodiment of the present invention;

FIG. 10 is a schematic illustration from the side of a reinforcing member of FIG. 9;

FIG. 11 is a top elevational view of a lacrosse head attached to a lacrosse handle in accordance with still another embodiment of the present invention;

DETAILED DESCRIPTION OF PREFERRED EMBODIMENT

Figure 1:
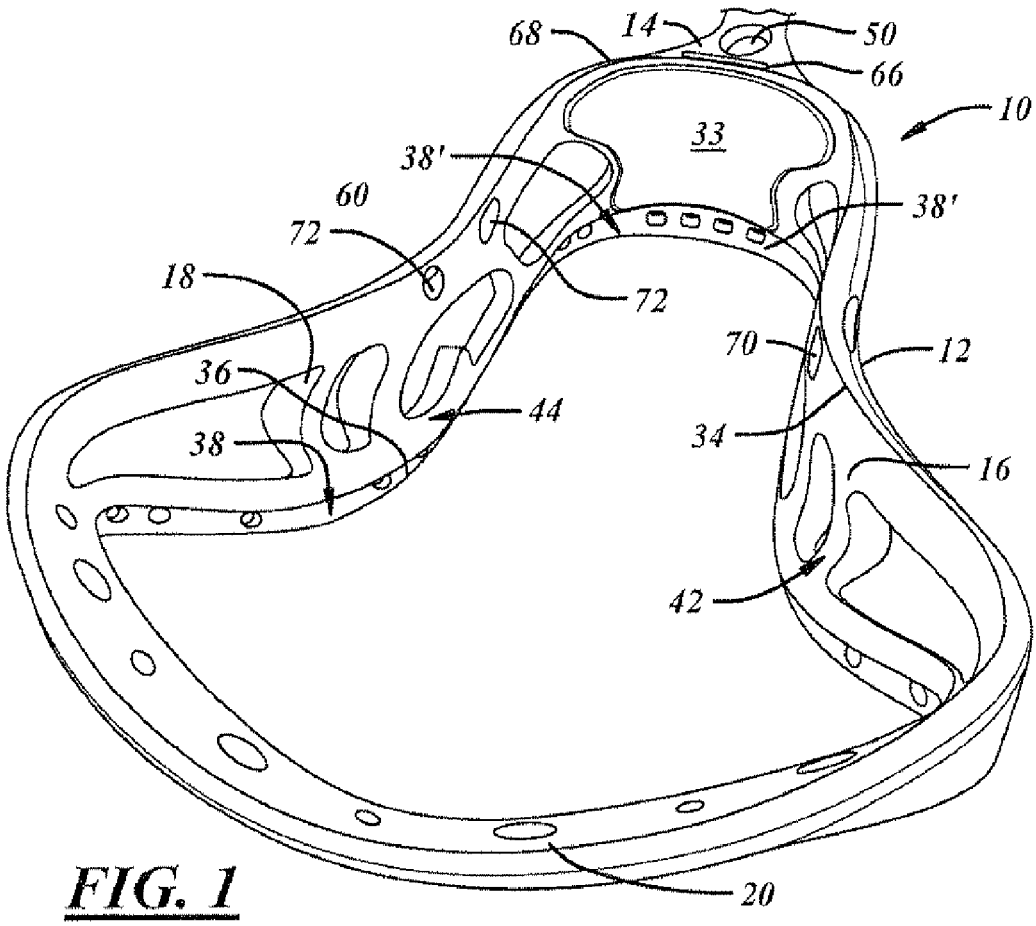
FIG. 1 is a perspective view of a lacrosse head in accordance with one embodiment of the present invention.
Figure 2:
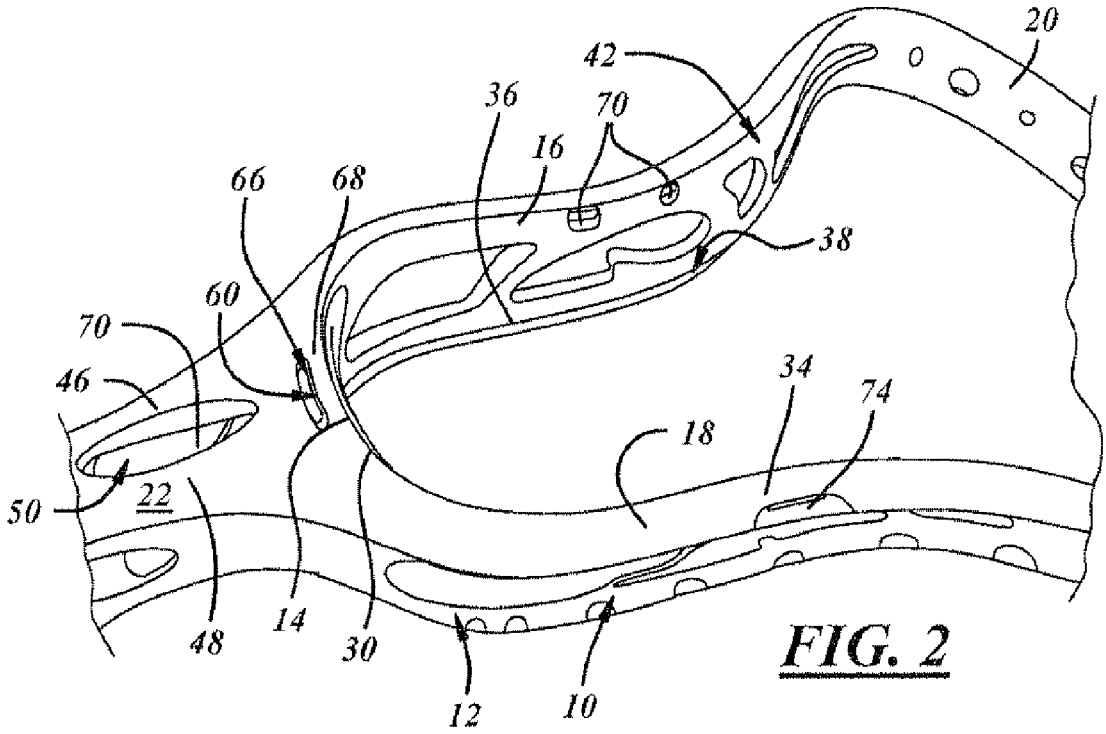
FIG. 2 is another perspective view of the lacrosse head of FIG. 1.
Figure 3:
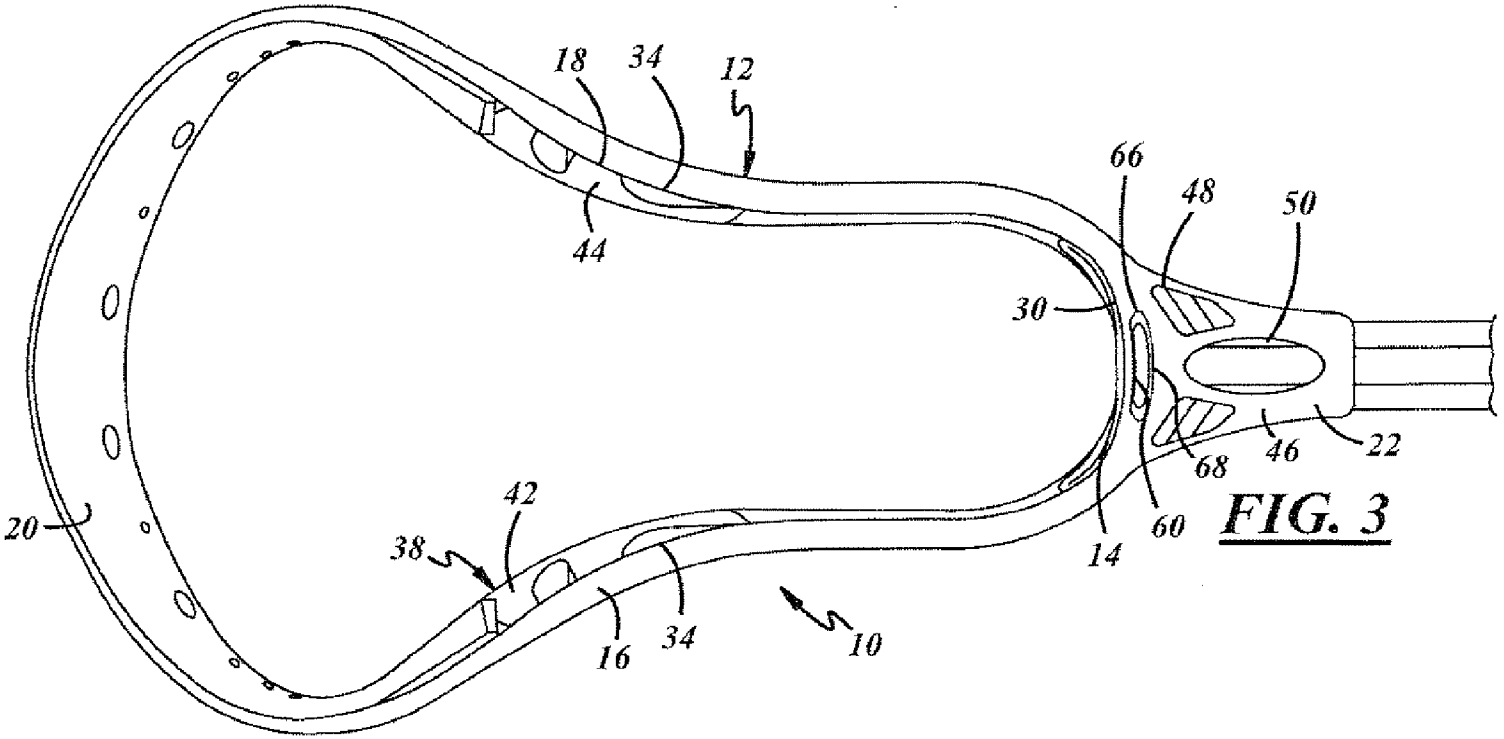
FIG. 3 is a top elevational view of the lacrosse head of FIG. 1.

In the following figures, the same reference numerals are used to identify the same components in the various views.

Referring now to the Figures, which illustrate a lacrosse head in accordance with the present invention. In one embodiment a lacrosse head is constructed of a polymeric plastic material and includes reinforcing members disposed therein. The reinforcing members are construed of a stronger material than the underlying polymeric plastic material, such as a metal. However, in accordance with the present invention and, as discussed in more detail below, the lacrosse head can be formed of a variety of different components and combinations of components designed to enhance the strength and stiffness of the lacrosse head in localized areas as desired. For example, the lacrosse head may include a stiffening coating on all or selected portions of the head. The stiffening coating may include any hardening compound or substance known to harden another material when treated or coated therewith. While the lacrosse head is preferably formed from an injection molding process with insert molding, a variety of other suitable processes may be utilized. Additionally, the reinforcing member or members can be constructed of a variety of different polymeric, non-polymeric or composite materials or structures or can be created by different processes. However, in accordance with the present invention, regardless of the materials from which they are constructed, the reinforcing members provide the frame element with localized areas of increased strength and stiffness.

As shown in FIGS. 1 through 7, the lacrosse head 10 has a frame element 12, which includes a base or ballstop portion 14, a pair of opposing sidewall portions 16, 18, and a scoop portion 20 connecting the pair of opposing sidewall portions 16, 18 opposite the ballstop portion 14. It will be understood that the frame element 12 can take on varying configurations. Further, each of the portions of the frame element 12 can also take on varying configurations, including a projecting base or ballstop portion 14. As shown in FIGS. 2 through 11, the lacrosse head 10 has a throat portion or socket 22 that extends generally rearwardly from the frame element 12 for attachment of a stick handle or element 24 thereto. It will also be understood that the throat portion or socket 22 can take on a variety of different configurations so long as it allows a handle 24 to be attached to or mated with the head 10 to form a complete stick. Further, while the head 10 and the handle 24 are discussed as separate components, it will be understood that they can be permanently attached to one another or can be formed as a single unitary structure.

Figure 6:
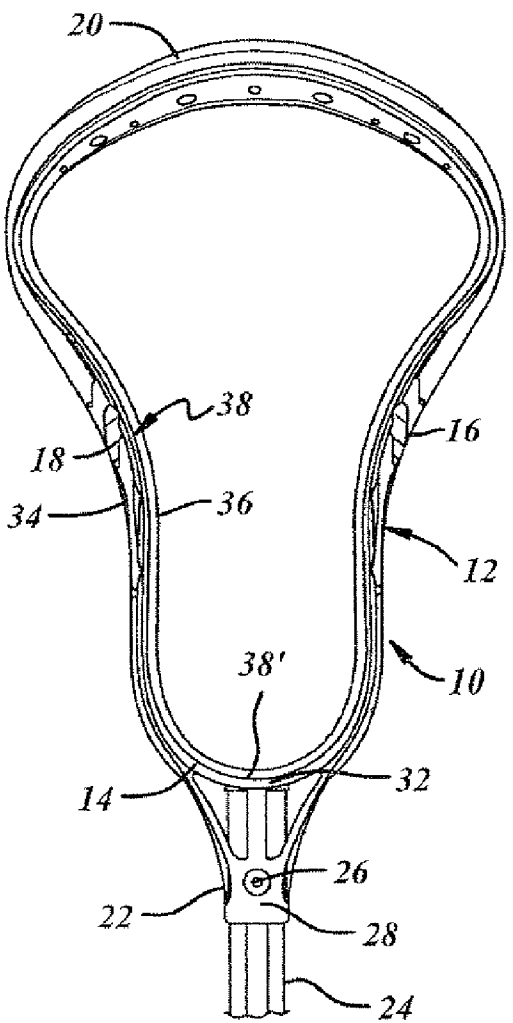
FIG. 6 is a bottom elevational view of the lacrosse head of FIG. 5.

As shown in FIG. 6, the stick handle 24 is preferably secured in the throat portion 22 by a securing means, such as a screw or the like, which is inserted into a fixation hole 26 formed in the throat portion 22. The fixation hole 26 is preferably formed in a lower surface 28 of the throat portion 22. However, it should be understood that the fixation hole 26 can be formed in any portion of the throat portion 22. It will also be understood by one of ordinary skill in the art that the handle 24 can be attached to the head 10 in a variety of different ways. In accordance with this embodiment, the head 10 also includes one or more reinforcing members disposed therein, which will be discussed in detail herein.

Figure 7:
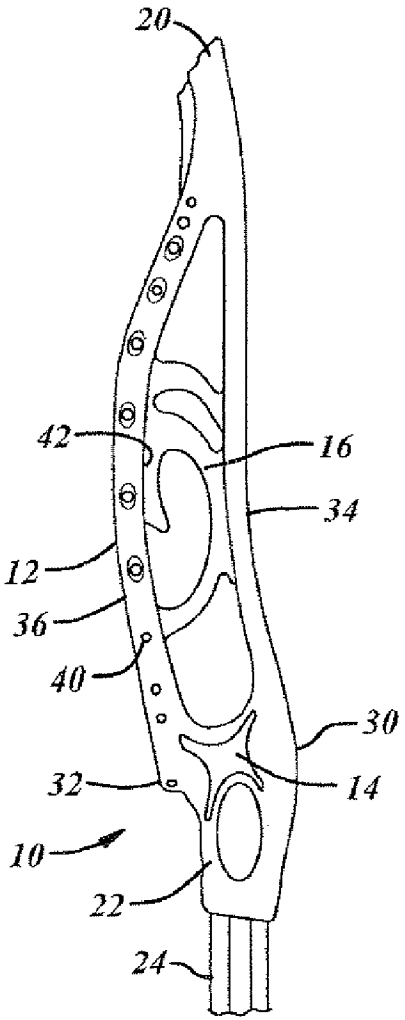
FIG. 7 is a side view of the lacrosse head of FIG. 5.

As shown in FIG. 7, the ballstop portion 14 has an upper rim 30 and a lower rim 32. The ballstop portion 14 also preferably has a resilient foam padding 33 (not shown) applied thereon to cushion the impact of a ball when in contact with the ballstop portion 14 and assist in keeping it in the head 10. Additionally, the sidewall portions 16, 18 each have an upper rim 34 and a lower rim 36. The upper rims 30 and 34 of the ballstop portion 14 and the sidewall portions 16, 18 respectively together in connection with the top of the scoop portion 20 define a ball receiving area while the lower rims of the ballstop portion 14 and the sidewall portions 16, 18 respectively 32 and 36 together in connection with the bottom of the scoop portion 20 define a ball retention area. The ball receiving area is functionally the portion of the head 10 where the lacrosse ball can enter or exit the head 10 such as when caught, thrown, shot, thrown or dislodged. The ball retention area is functionally the portion of the head 10 where the ball typically resides when retained in the head and where the netting is generally attached to the head 10.

Additionally, the frame element 12 includes net securing structures 40 formed therethrough to allow attachment of a netting. The net securing structures 40 are preferably stringing holes that are formed through the head 10 and are preferably formed adjacent the ball retention area. However, it will be understood that a variety of other net securing structures may be utilized. Further, the net securing structures 40 may also be formed in other locations on the frame element 12 to provide varying locations for attachment of the netting to provide varying pocket configurations and depths for different playability characteristics. Additionally, the frame element 12 may have multiple different net securing structures 40 disposed in different locations height-wise on the frame element 12 to allow the netting to be attached to the head 10 in multiple positions as desired by a player.

Figure 5:
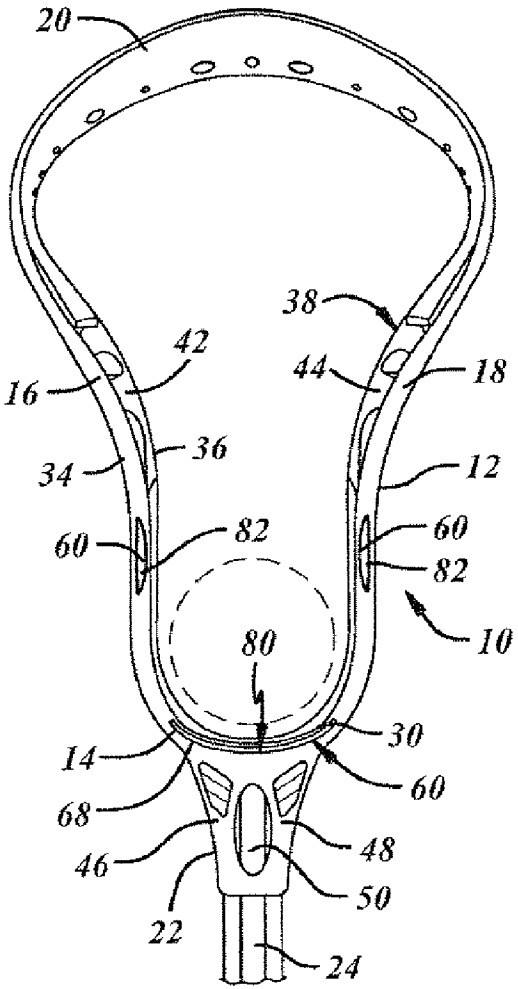
FIG. 5 is a top elevational view of a lacrosse head attached to a lacrosse handle in accordance with another embodiment of the present invention.

In one embodiment shown in the FIGS. 5 and 6, the lower rims 36 of each of the sidewall portions 16, 18 are preferably recessed with respect to the sidewall portions 16, 18 to form a channel 38, which provides additional ball retention capabilities as will be understood by one of ordinary skill in the art. In this embodiment, the channel 38 is recessed outwardly with respect to an inner surfaces 42, 44 (shown in FIG. 7) of each sidewall portion 16, 18. Additionally, the lower rim 32 of the ballstop portion 14 is preferably recessed with respect to the ballstop portion 14 to form a channel 38'. The channels 38, 38' preferably have a plurality of net securing structures 40 located therein. The channels 38, 38' can accommodate the net securing structures 40 to prevent undue wear on the netting due to movement of the ball and also provide increased ball control, by assisting in retaining the ball in the head 10. It will be understood that the channels 38, 38' can take on a variety of configurations and shapes as will be understood by one of ordinary skill in the art. For example, they can be angled or curved as desired.

As also shown in the FIGS. 5 and 6, each sidewall portion 16, 18 is preferably configured such that it extends generally outwardly or flares in the direction from the lower rims 34 to the upper rims 36, as will be understood by one of ordinary skill in the art. This flaring creates a "pinched" configuration of the sidewalls to assist in the ball retention capabilities of the head 10 without sacrificing the ability to catch the ball as also will be understood by one of ordinary skill in the art. The degree to which each sidewall portion 16, 18 tapers or flares may be entirely uniform from the ballstop portion 14 to the scoop 20, may progressively increase, may progressively decrease or take on a variety of other configurations as will be understood by one of ordinary skill in the art. It will be understood that the inner surfaces 42, 44 of the sidewall portions 16, 18 may be curved, arcuate, sloped, convex, stepped, or any combination of the above. Moreover, different portions of a single sidewall can take on a variety of different shapes.

Additionally, in FIG. 5 the throat portion 22 preferably has a bridge portion 46, 48 located on either side of a generally elliptical opening 50 which is formed in an upper surface of the throat portion 22. Each of the bridge portions 46, 48 is integrally molded to a respective sidewall portion 16, 18 in order to strengthen the connection of the throat portion 22 to the frame element 12. This connection through the inclusion of the bridge portions 46, 48 minimizes throat breakage and decreases the amount of deflection or flex that would be present in the head 10 during shooting and passing as will be understood by one of ordinary skill in the art.

In accordance with the present invention, the disclosed lacrosse head 10 includes one or more reinforcing members disposed or located substantially within the interior of the head 10 to provide increased strength to certain selected portions of the head, as set forth in more detail below while allowing the non-selected portions to flex normally. These selected portions are predetermined by the head designer prior to the molding or forming process of the head such that the resultant head has desired strength, flex, stiffness and playability characteristics. The reinforcing members can thus be located or positioned in a variety of different positions or locations within the head, as is exemplarily illustrated by the embodiments below. In one embodiment the reinforcing members or components are preferably formed of a material, such as titanium or other strong lightweight material However, a variety of other polymeric, non-polymeric or composite materials, components or structures can also be utilized, as discussed in more detail below.

FIGS. 1 through 4 illustrate a reinforced lacrosse head 10 in accordance with one embodiment of the present invention. As shown, the lacrosse head 10 is preferably formed of a polymeric plastic material including polyamides such as nylon 6, 6. However, the lacrosse head can be formed of a variety of other or different polymeric, non-polymeric or composite materials. In accordance with this embodiment, at least one reinforcing member is molded or otherwise disposed within the head 10 to provide increased strength at a selected location and thus minimize flex. While a single reinforcing member is illustrated, it will be understood that a plurality of reinforcing members can be utilized.

In this embodiment, the reinforcing member 60 preferably consists of a titanium wire that is molded in the head through an insert molded process. It will be understood that the reinforcing member can be constructed of a variety of other suitable polymeric, non-polymeric and composite materials, including other types of metal or nonmetal. An example of the titanium wire used for the reinforcing member 60 is shown in FIGS. 9 and 10. An example of a suitable wire is an 11 gauge wire or 0.1160 diameter titanium wire. However, it will be understood that this is merely exemplary and that other sizes, and materials can be utilized. The length and size of the reinforcing member 60 (as well as the number of members) is predetermined by the designer based on the desired strength, stiffness and other playability characteristics desired. In this embodiment, the reinforcing member 60 is insert molded in the head 10 such that it is disposed adjacent the top or front side of the head 10, i.e. adjacent the upper rims 34 of the sidewall portions 16, 18 and the upper rim 30 of the ballstop portion 14. However, the reinforcing member 60 can be disposed in other locations in the head 10 and can be formed therewithin by other methods, as discussed below.

As shown, the reinforcing member 60 has a predetermined shape for maintaining at least one contour of the lacrosse head 10 as will be understood by one of skill in the art. Here, the reinforcing member 60 is sized and shaped for molding in the head in a generally U-shape such that it is positioned in the ballstop portion 14 and a portion of each of the sidewall portions 14, 16. An exemplary reinforcing member 60 is shown in FIGS. 9 and 10. The reinforcing member 60 is configured in a generally U-shape to match the desired shape and thus has a pair of opposing end portions 62, 64. As shown in this embodiment, the end portions 62, 64 of the reinforcing member 60 preferably extends to at least the midpoint of the sidewalls in order to increase the rigidity of the head 10. However, the reinforcing member 60 can be positioned in any portion of the head 10. In fact, more than one reinforcing member can be 60 disposed in the same vertical location on the head 10 (i.e. when viewed from the side). Alternatively, it will be understood that a reinforcing member can be disposed in or as part of the channel 38 and/or the channel 38' to strengthen the area of the head 10 associated with the channels 38, 38'.

Figure 4:
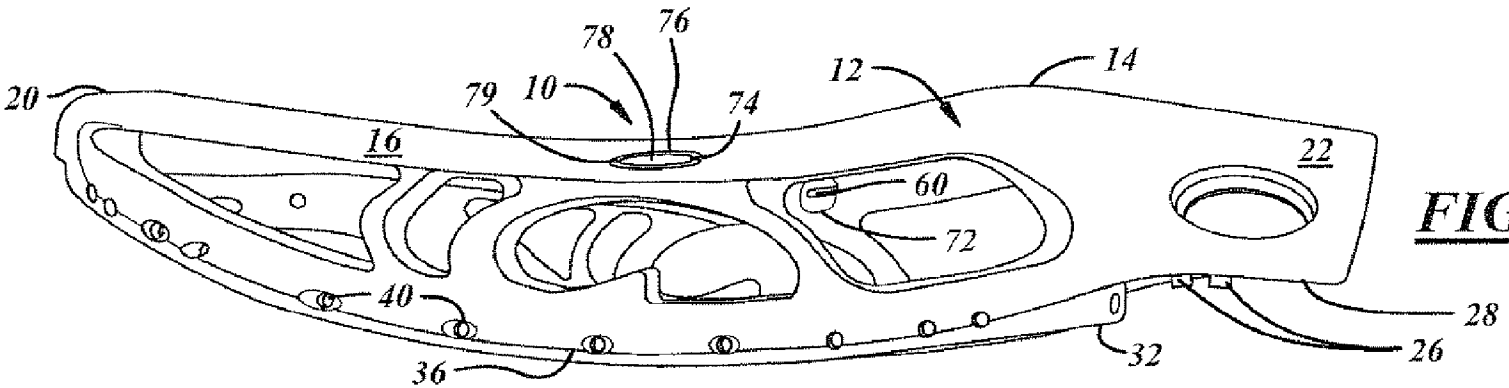
FIG. 4 is a side view of the lacrosse head of FIG. 1.

As discussed above, the reinforcing members are preferably disposed within the interior of the head 10 or inside the polymeric plastic material. In accordance with one embodiment, the reinforcing member 60 is preferably visible to the exterior, through various openings formed in the head during the molding or forming process. For example, in this embodiment, an opening 66 is formed in an upper surface 68 of the ballstop portion 14. A pair of openings 70, 72 are formed in each inner surface 42, 44 of the sidewall portions 16, 18. Additionally, an opening 74 is formed in the outer surface of each of the sidewall portions 16, 18. It will be understood that the openings can take on a variety of different shapes and sizes and allow the reinforcing member 60 to be viewed from the exterior of the head 10. For example, as best shown in FIG. 4, the opening 74 has an outer perimeter 76. The opening 74 tapers inwardly from the outer perimeter 76 to a throughhole 78 defined by an inner perimeter 79. The reinforcing member 60 is exposed by the throughhole 78 such that the reinforcing member 60 is visible from the exterior of the head 10. Additionally, the openings allow additional material to be removed, which decreases the amount of plastic required to make the head 10 and thus makes it lighter.

FIGS. 5 through 7 illustrate another embodiment of a lacrosse head 10 in accordance with the present invention. In this embodiment, the lacrosse head 10 also includes a reinforcing member 60 disposed therein Again, the reinforcing member 60 is disposed adjacent the upper surface or rim of the head 10 and is molded therein by an insert molding process. However, as discussed above, it will be understood that the reinforcing member 60 can be located in other portions of the head 10, including the middle of the head or adjacent the lower surface or rim of the head 10. The reinforcing member 60 can also be formed in the head 10 by a variety of other suitable processes. The head 10, in this embodiment, also has openings, as discussed below, that allow a portion of the reinforcing member 60 to be seen from the exterior of the head 10. Additionally, because the reinforcing member 60 is recessed or set back a certain distance with respect to the exterior of the head 10 there is no concern of it contacting another player during play.

As also show in FIGS. 5-7, a plurality of openings are formed in the upper surface of the open frame 12, such that the reinforcing member 60 can be seen when viewed from the exterior of the head 10. A first opening 80 is formed in the upper surface 68 of the ballstop portion 14. The opening 80 is larger than the opening 68 in the embodiment of FIGS. 1 through 4, which allows the head 10 to be formed with less plastic, thereby allowing it to be lighter. Additionally, a second opening 82 is formed in the upper rims 34 of each of the sidewall portions 16, 18. These openings also allow the weight of the head 10 to be reduced without affecting or compromising the strength of the head 10. It will be understood that the openings can take on a variety of different configurations. In this embodiment, the reinforcing member 60 preferably has the same shape as that discussed in connection with FIGS. 1 through 4, namely see FIGS. 9 and 10. However, as will be appreciated, the number, size, location, and configuration of the reinforcing members can vary.

FIG. 8 illustrates another embodiment of a lacrosse head 10 in accordance with the present invention. The lacrosse head 10 includes a plurality of openings formed in the upper surface of the frame element 12. A first opening 80 is formed in the upper surface 68 of the ballstop portion 14. This opening is configured generally the same as the opening 80 in the embodiment of FIG. 5. Additionally, the upper rims 34 of the sidewall portions 16, 18 have an opening 84 formed therein to allow the reinforcing member 60 to be viewed from the exterior of the head 10. The opening 84 is formed closer to the ballstop portion 14 than the opening 82 in FIG. 5. This allows a reinforcing member 60 with shorter opposing end portions 62, 64 to be utilized to provide varying flex and strength. Again, as set forth above, instead of a single reinforcing member, multiple reinforcing members may be utilized.

FIG. 11 illustrates still another embodiment of a lacrosse head 10 in accordance with the present invention. In this embodiment, the upper surface of the frame element 12 has a plurality of openings formed therein that extend and are interposed substantially along the lengths of the sidewall portions 16, 18. Thus, in this embodiment, the reinforcing member 60 extends along the sidewall portions 16, 18 to a location at least near the scoop portion 20. More preferably, the reinforcing member 60 extends all the way to the scoop portion 20. As shown, the upper surface of the frame element 12 includes an opening 90 formed in the upper surface 68 of the ballstop portion 14. The upper surface of the frame element 12 has a pair of opposing openings 92 formed therein adjacent the opening 90. The upper rims 34 of the sidewall portions 16, 18 each have openings 94, 96 formed therethrough that allow the reinforcing member 60 to be seen from the exterior of the head. The upper rims 34 of the sidewall portions 16, 18 also have openings 98 formed therein adjacent the scoop portion 20. Thus, the reinforcing member 60 in this embodiment is longer (extends further along the sidewall portions) than in the prior embodiments. Additionally, the reinforcing member 60 is preferably disposed adjacent the upper surface of the frame element 12. However, it will be understood, that the reinforcing member 60 can take on a variety of different configurations and can be located in different portions of the head 10. It will also be understood that instead of a single reinforcing member multiple reinforcing members can be disposed in the frame element 12 such that they reinforce the pre-selected areas in this embodiment. Further, more than one reinforcing member can be located at a single horizontal location, when the head 10 is viewed from the side, but at different vertical locations, i.e. as determined between the lower and upper rims.

The reinforcing member 60 may have a variety of shapes and configurations for example, it may be contoured in three dimensions to correspond to the shape of the head 10 in a particular area. Additionally, the reinforcing member 60 may extend from the ballstop portion 14 to various distances or locations along the length of the head 10. For example, the reinforcing member 60 can extend a predetermined distance along each of the sidewall portions 16, 18. Alternatively, the reinforcing member 60 can extend to the scoop portion 20 or entirely around the circumference of the head 10. Additionally, the reinforcing member 60 can lie in generally the same plane or can traverse upwardly and downwardly (with respect to the upper surface of the frame element 12) depending upon the configuration of the head 10. Moreover, the reinforcing member 60 can be constructed in multiple discrete pieces that are disposed in the head 10 at different predetermined locations. This will allow for reinforcement only where desired. In another embodiment, a reinforcing member 60 can be disposed in the head 10 adjacent the upper rim 34 of the sidewall portions 16, 18 and a second reinforcing member 60 can be disposed in the head 10 adjacent the lower rims 36.

Figure 12:
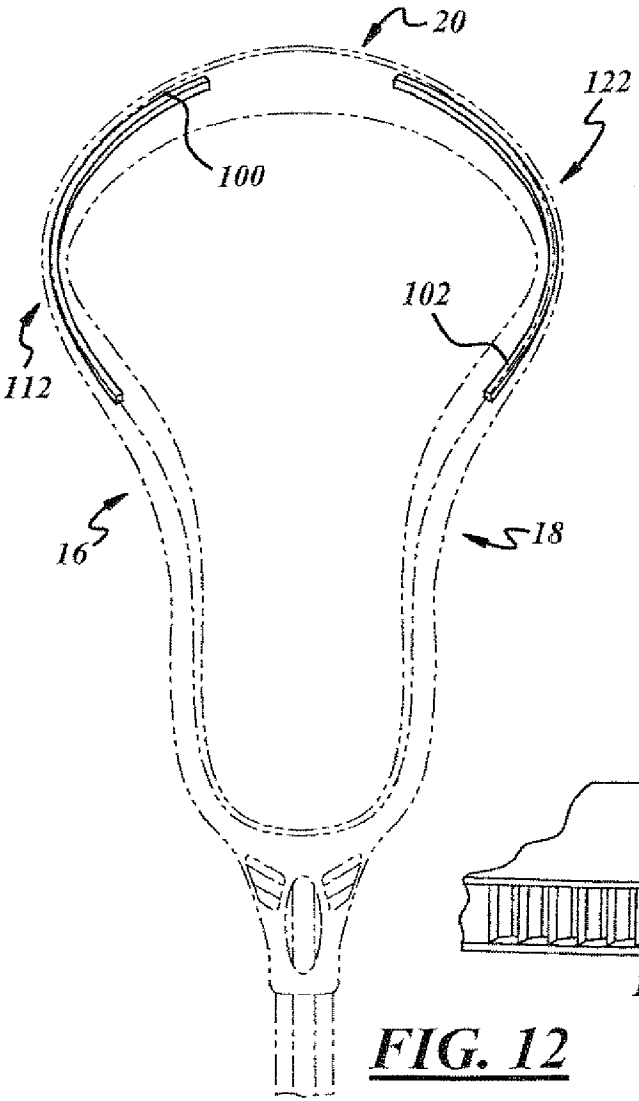
FIG. 12 is a schematic illustration of a lacrosse head with exemplary reinforcing members disposed therein in accordance with one embodiment of the present invention.

It will be understood that the reinforcing members can be located in the head 10 in a variety of different locations to provide different stiffness and playability characteristics. A variety of different exemplary embodiments of reinforcing members configured for specific portions of a head are illustrated in FIGS. 12 through 16 and 4are discussed below. In one example, a reinforcing member 100 is disposed in the frame element 12 in an upper area 122 of the head 10, including a portion of the left sidewall 16 and a portion of the scoop portion 20. As shown, the reinforcing member 100 is intended to strengthen this area, as schematically illustrated in FIG. 12. Additionally, a reinforcing member 102 is disposed in the frame element 12 in an opposing upper area 122 of the head 10, including a portion of the right sidewall 18 and a portion of the scoop portion 20. The reinforcing member 102 is intended to strengthen this area in the right sidewall and the scoop portion 20.

Figure 13:
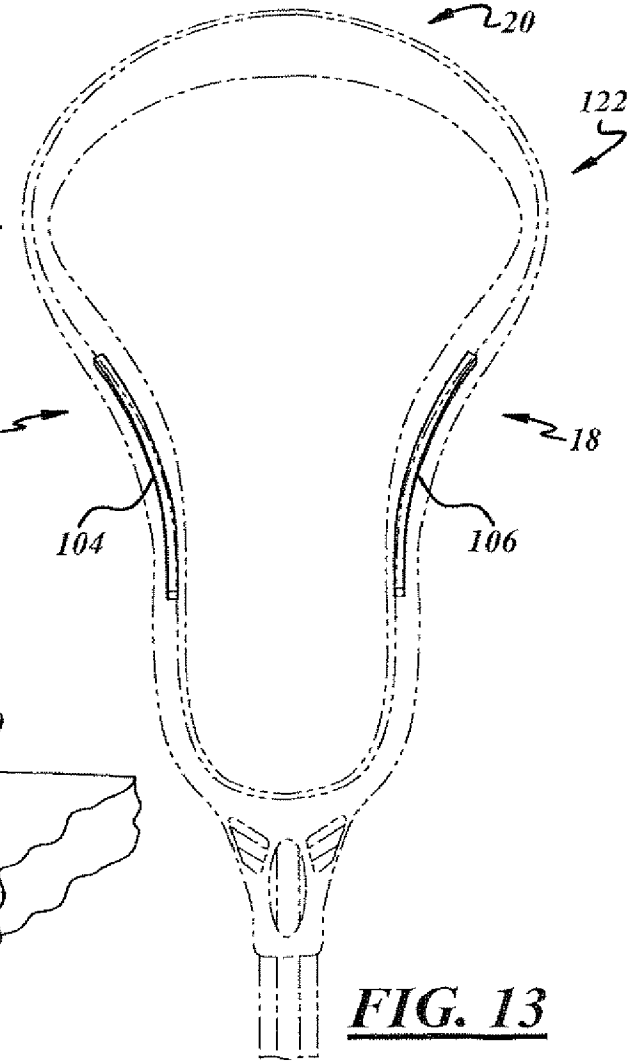
FIG. 13 is a schematic illustration of a lacrosse head with exemplary reinforcing members disposed therein in accordance with another embodiment of the present invention.
Figure 14:
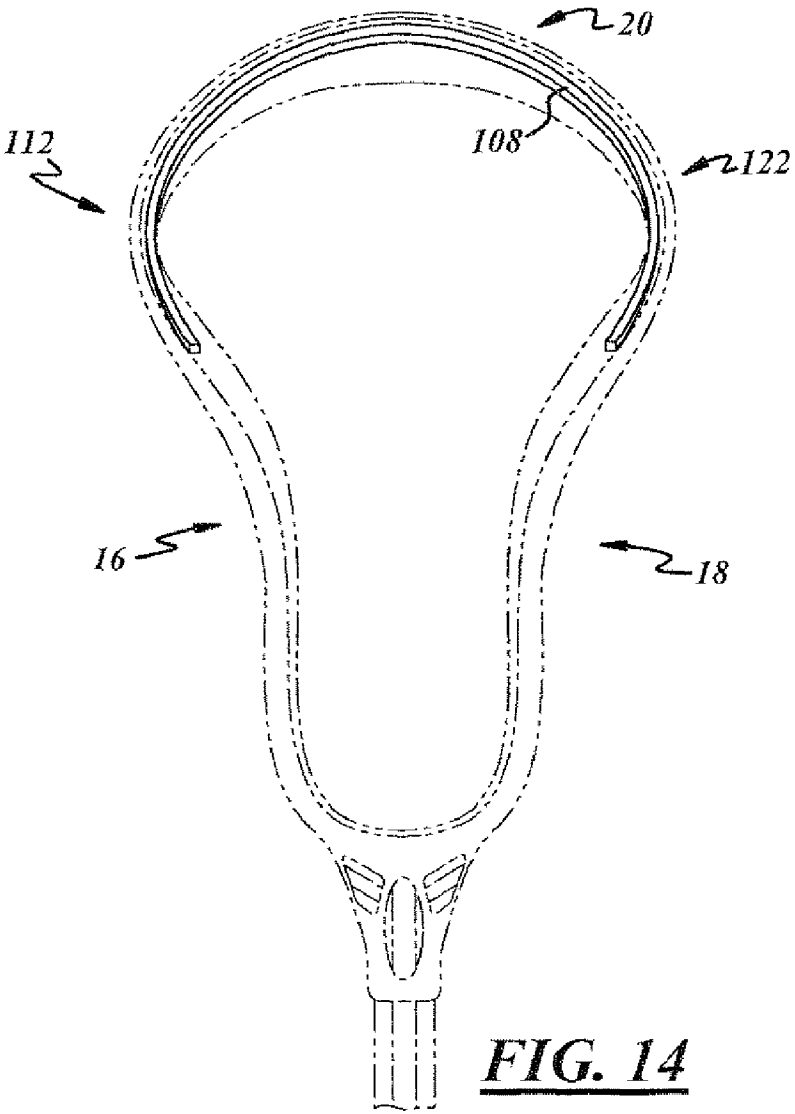
FIG. 14 is a schematic illustration of a lacrosse head with exemplary reinforcing members disposed therein in accordance with still another embodiment of the present invention.

In another example, a reinforcing member 104 is located generally in the middle portion of the left sidewall portion 16, as schematically illustrated by FIG. 13. A reinforcing member 106 is also disposed in the frame element 12 generally in the middle portion of the right sidewall portion 18. In still another example, a reinforcing member 108 is disposed in the frame element 12 such that it extends from the upper area of the left sidewall portion 16 through the scoop portion 20 and into the upper area of the right sidewall portion 18. The scoop reinforcing member 108 is schematically illustrated in FIG. 14 and provides increased strength to the connections between the sidewall portions and the scoop portions and throughout the entire scoop portion 20.

Figure 15:
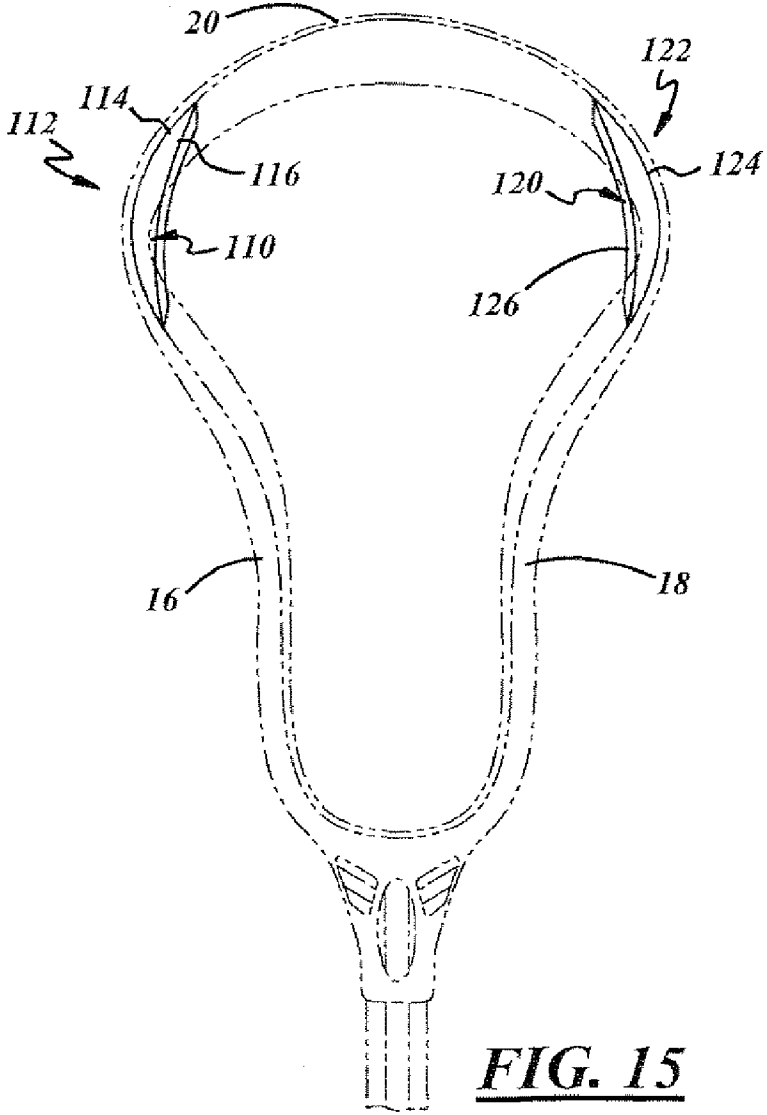
FIG. 15 is a schematic illustration of a lacrosse head with exemplary reinforcing members disposed therein in accordance with a further embodiment of the present invention.

Referring to FIG. 15, which illustrates still another exemplary embodiment of a lacrosse head 10 in accordance with the present invention. In this embodiment, the head 10 includes a reinforcing member 110 which is disposed in the upper area 112 of the left side of the head 10. The reinforcing member 110 is preferably located such that at least a portion of it is encapsulated in the plastic in the upper area 112 on the left side of the head 10. In another embodiment, the entire reinforcing member 110 is disposed in the frame element 12. The reinforcing member 110 includes a first portion 114 that is disposed in the head 10 closer to the outer surface of the frame element 12. The reinforcing member 110 also includes a second portion 116 that is curved to generally match the inner contour of the upper area 112, where the reinforcing member 110 is disposed. The second portion 116 can lie flush with the interior surface of the frame or can extend inwardly (toward the handle center line) from the inner surface, or can be entirely encapsulated within the frame element. In the embodiment where the second portion 116, extends slightly inwardly, the reinforcing member 110 serves as a ball retention feature. It will be understood that the vertical location of the reinforcing member 110 can obviously vary as desired.

As also shown in FIG. 15, a reinforcing member 120 can also be included in the polymeric plastic material in the upper area 122 of the right side of the head 10. Again, the entire reinforcing member 120 is disposed in the frame element 12. The reinforcing member 120 includes a first portion 124 that is disposed in the frame element 12 closer to the outer surface and a second portion 126 that is curved in shape to generally match the inner contour of the upper area 122, where the reinforcing member 120 is disposed.

Figures 16, 17, 18:
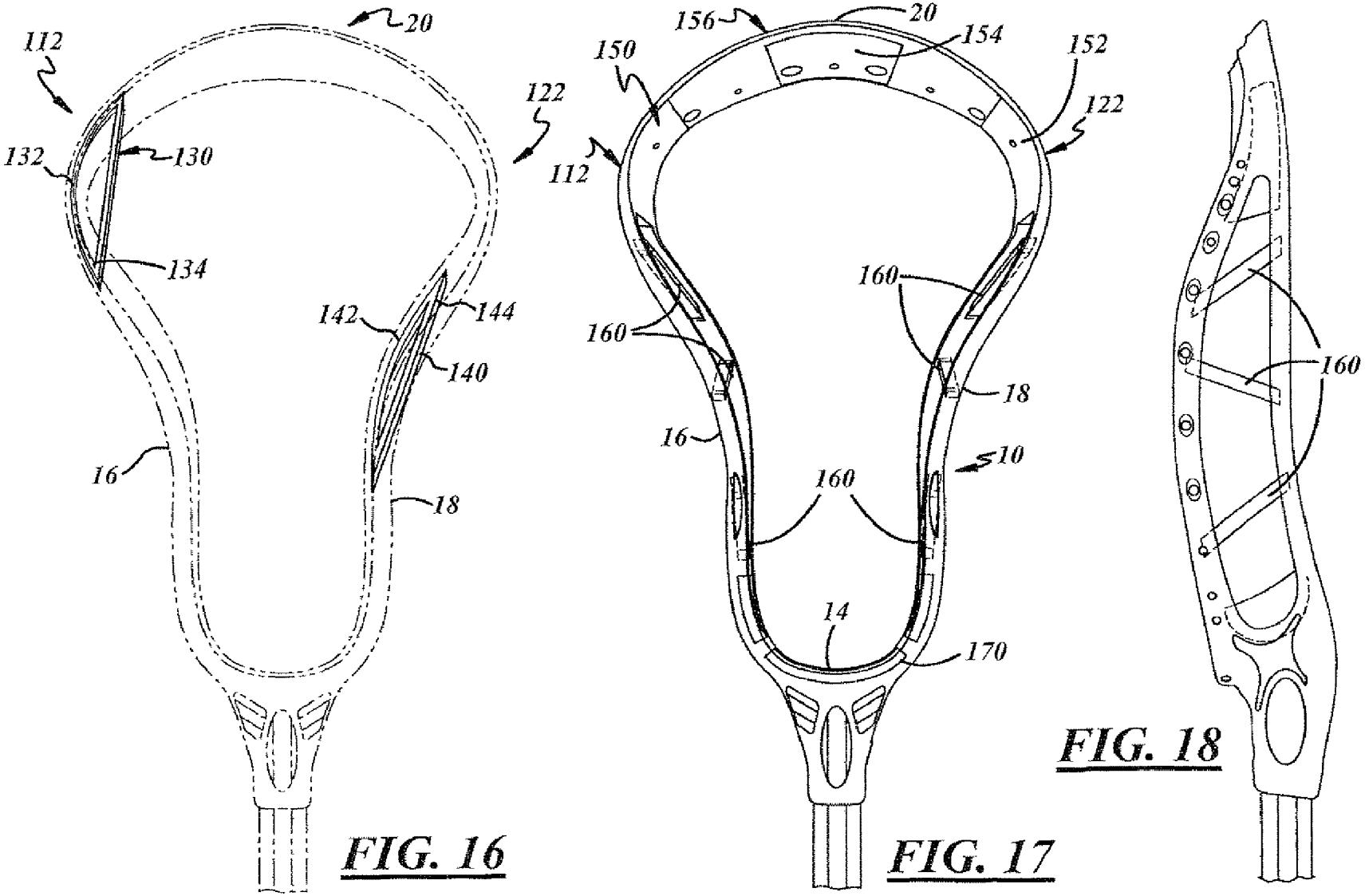
FIG. 16 is a schematic illustration of a lacrosse head with exemplary reinforcing members in accordance with yet a further embodiment of the present invention.
FIG. 17 is a top elevational view of a lacrosse head attached to a lacrosse handle in accordance with still another embodiment of the present invention.
FIG. 18 is a side view of the head of FIG. 17.

Referring to FIG. 16, which illustrates yet other exemplary embodiment and location for reinforcing members in a lacrosse head. A first reinforcing member 130, acts as a stiffening member for the lacrosse head 10 in the upper area 112 of the left side of the frame element 12. The reinforcing member 130 is embodied as an open frame structure such that a first portion 132 extends and is disposed within the upper area 112. In one embodiment, the reinforcing member 130 is contoured to match a curvature of the upper area 112. The reinforcing member 130 further includes a second portion 134 or stiffening rod to reduce the effects of stress between the sidewall portion 16 and the scoop portion 20 in the upper area 112. The second portion 134 can lie flush with the interior surface of the frame or can extend inwardly from the inner surface, in which case it can serve as a ball retention feature. Additionally, the second portion 134 can be contoured to generally match the curve of the head. The area between the first portion 132 and the second portion 134 is generally open to form the frame structure. It will be understood that the reinforcing member can also be disposed in the upper area 122 of the left side of the head 10.

A reinforcing member 140 is disposed within the right sidewall portion 18 to provide reinforcement thereto. The reinforcing member 140, includes a first portion 142 coupled or molded within the sidewall portion 18 a predetermined or preselected location. The reinforcing member 140 also includes a second portion 144 or stiffening rod portion for stiffening the sidewall portion 18. In one embodiment, the second portion 144 is disposed outside the exterior of the head 10. The reinforcing members may be included in the head 10 in high impact or wear areas or high flex areas in a manner tailored specifically to a particular player based on analyses of the players' style of play. Therefore, a predetermined pattern for the reinforcing members may be included in a head optimally designed for a particular player. Further, it will be understood by one of ordinary skill that the reinforcing member 140 can also be formed in the left side of the head as well as at other locations along the sidewall length.

It will be understood that these are merely examples of reinforcing members that can be formed in a head to vary its strength and playability characteristics. The reinforcing members in these examples are preferably constructed of a metal material. More preferably, they are constructed of a lightweight metal, such as titanium. However, the reinforcing members can be formed of any suitable material that is stronger than the underlying polymeric plastic material from which the frame element 12 is constructed so that the reinforcing member or members provide strength to the head 10 at predetermined locations. Thus, the reinforcing material may consist of one or more polymeric materials, non-polymeric or composite materials that are compatible with the underlying polymeric plastic materials. Additionally, the reinforcing members can take on a variety of different shapes, sizes and configurations. Further, as discussed in more detail below, the reinforcing members need not be a separate physical component, but can be a material or coating that, when cured or in its formed state, has greater strength properties than the underlying material from which the head is constructed.

Referring to FIGS. 17 and 18, which illustrate another embodiment of a multi-component head 10 for a lacrosse stick including a plurality of reinforcing members and support structures. In one embodiment, the reinforcing members are constructed of a lightweight metal, such as titanium. However, other polymeric, non-polymeric or composite materials may also be utilized. In this embodiment, a plurality of reinforcing members are disposed or located as part of the head 10 to provide increased strength and playability characteristics. As shown, a pair of reinforcing members 150, 152 are disposed in the upper areas 112, 122 of the left and right sides of the head 10, respectively. The reinforcing members 150, 152 are formed generally in the transition area of the sidewall portions 16, 18 and the scoop portion 20. The reinforcing members 150, 152 are preferably formed from a lightweight metal, such as titanium. However, a variety of other polymeric, non-polymeric or composite materials or components may instead be utilized. The reinforcing members 150, 152 are preferably fully encapsulated within a polymeric plastic material. It will be understood that other configurations or arrangements can also be utilized.

Additionally, a reinforcing member 154 is formed generally in a middle area 156 of the scoop portion 20. The reinforcing member 154 can be entirely encapsulated in the material from which the head is formed, i.e. polymeric plastic, or can be exposed to the interior or exterior of the head 10. Further, the reinforcing member 154 can be formed from the same polymeric, non-polymeric or composite material as the reinforcing members 150, 152. Alternatively, the reinforcing members can be formed from polymeric, non-polymeric or composite materials having different stiffnesses and strengths to provide varying characteristics to different portions of the head 10 as desired.

Further, as is shown with open sidewall lacrosse heads, the sidewall portions 16, 18 have one or more support members 160 generally extending between an upper portion of the frame element and a lower portion of the frame element 12. Currently, these support members 160 are made from a polymeric plastic material. In this embodiment, the support members 160 are at least partially constructed of a stiffer material then the base material of the head 10. For example, the support members 160 can have a stronger metal material insert molded or otherwise disposed within the support members 160, such as titanium. Alternatively, the support members 160 could be entirely exposed or formed of a stiffer material, such as a polymeric, non-polymeric composite material. In other words, the reinforcing material which comprises the support members 160 are entirely exposed between their connection with upper portion and the lower portion. The connection of the reinforcing material with the upper portion and the lower portion of the frame element 12 can be a mechanical connection or a chemical connection. This configuration provides increased axial and cross-axial or side-to-side torque resistance.

Also the ballstop portion 14 has a reinforcing member 170 disposed therein. The reinforcing member 170 is embodied as arcuate and conforming to the general shape of the ballstop portion 14 and having a surface area that may extend the width and/or length of the ballstop portion 14, as discussed above in connection with prior embodiments above.

Figure 19:
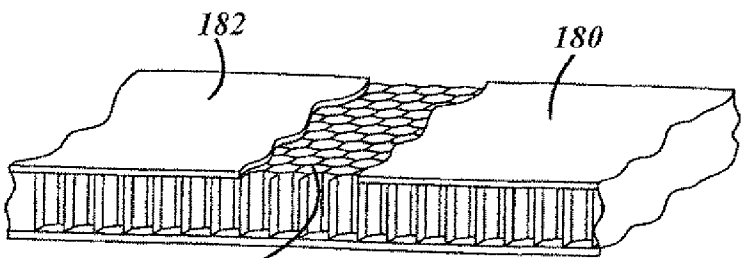
FIG. 19 is a schematic illustration of a section of composite material in accordance with a preferred embodiment of the present invention.

In FIG. 19, an example of a composite material 180 of the present invention is illustrated. The composite material 180 may be included in any portion of the head 10 and may also be used as an insert or reinforcing member, such as the reinforcing member 170 of FIG. 17. The composite material 180 may be a panel composition honeycomb core design including a skin 182 and honeycomb core 184. The skin 182 may be formed of light weight materials such as titanium or aluminum. The skin 182 may also be formed of a polymeric, non-polymeric or composite material. Unidirectional or woven glass or carbon fiber materials may also be included within the polymeric skin. Preferred polymeric materials include polyamides such as nylon 6, 6.

The honeycomb core 184 preferably consists of a polymeric or fiber reinforced polymeric material. Unidirectional or woven glass or carbon fibers may be included within the polymeric honeycomb core 184.

It will be understood that the polymeric, non-polymeric composite materials that make up the various components of the lacrosse head 10 and the reinforcing member or members are not critical only that the different materials have different strengths or stiffnesses. Alternatively, the materials or structure could consist of the same basic material that is subject to a hardening process or by application of hardening material, such as a polymeric or non-polymeric coating.

In accordance with the present invention, a method for forming a lacrosse head in accordance with one embodiment is provided. The unique method allows a lacrosse head to be tuned to provide different combinations of flexibility and strength. In accordance with one embodiment, a method for forming a lacrosse head 10 includes determining an optimal flex pattern, forming a reinforcing material in a predetermined pattern corresponding to the optimal flex pattern, forming a head around the predetermined pattern or forming the head such that the predetermined pattern may be coupled thereto. A head 10 may also be formed such that a lower half thereof is reinforcing material while an upper half is polymeric plastic. Further, the polymeric plastic half may be detachable and replaceable. For embodiments including detachable and replaceable sections on the lacrosse head, any known fastening or attaching method may be used, such as latches, springs locks, interlocking components, or other fasteners. Alternatively, instead of a mechanical connection, the two halves of the head could be coupled by a non-mechanical connection.

Figure 20:
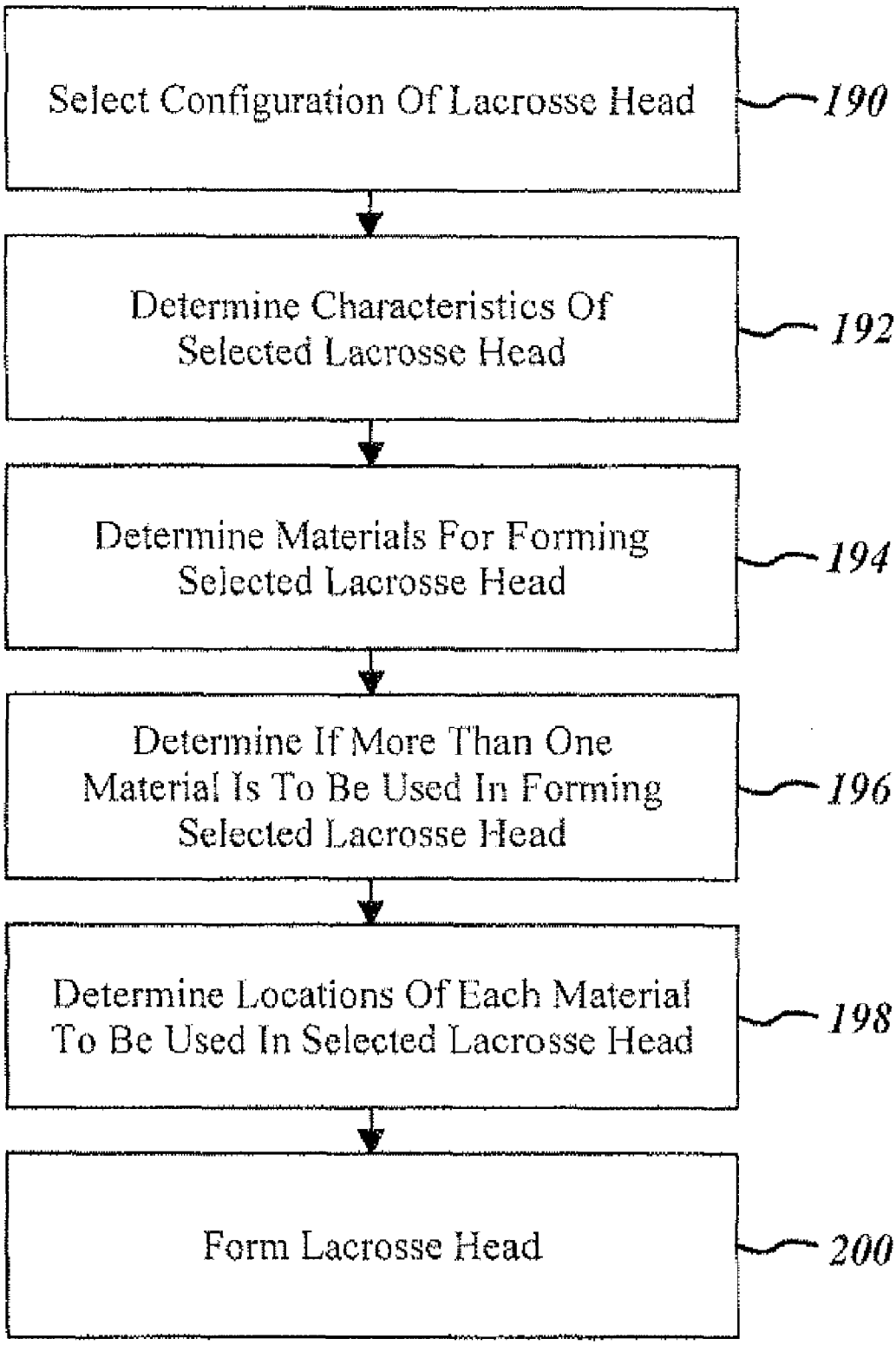
FIG. 20 is a logic flow diagram for forming the lacrosse head in accordance with the preferred embodiments.

In accordance with the present invention, a method of forming a lacrosse head is also provided. In accordance with this method, a lacrosse head 10 can also be tuned or tailored to provide different characteristics at different portions of the head as predetermined prior to manufacture thereof. As shown in the schematic flow chart of FIG. 20, a lacrosse head having a predetermined configuration is selected, as generally indicated by reference number 190. Additionally, the characteristics of the head, including stiffness, weight, flexibility are also determined, as generally indicated by reference number 192. Similarly, the polymeric, non-polymeric or composite material or materials from which the head 10 is to be formed are also determined, as generally indicated by reference number 194.

It is known that different portions of a lacrosse head are subjected to stresses that other portions of the same head are not subjected to. It is also known that it would be desirable to have a head where certain portions have different characteristics than other portions of the head based on the stresses to which they are subjected or based on the desired performance characteristics of the head. Thus, in accordance with this embodiment, if the head is to consist of more than one material or component (i.e. non-homogeneous), the types of materials or components from which the head will be constructed are determined, as generally indicated by reference number 196. Additionally, if the head is to be formed by multiple materials or components, the portions of the head that will consist of which material, whether in whole or in part, are also determined as generally indicated by reference number 198. For example, there are certain portions of a lacrosse head that, because they are subjected to more stress than other portions, can flex or break. The present method thus allows certain portions of the head to be constructed of a stronger material than the other portions of the head without significantly impacting the weight of the head, while also improving playability, as discussed in more detail below. In other words, according to the present method, a lacrosse head can be formed where certain portions of the head have increased strength or decreased flexibility as compared to other portions due to the inclusion of reinforcing members or structures formed therein that are formed from a stronger material.

In accordance with the method, once the configuration of the head has been determined, the materials or components have been selected, and the locations of which portions of the head will constructed of which materials or components, the head is then formed, as generally indicated by reference number 200. In accordance with one embodiment, the formation process occurs by co-molding. According to this process, a mold is provided that has a cavity is shaped to match the configuration of the head, as determined above. Thereafter, in accordance with known injection molding processes, the materials are injected into the mold cavity into the predetermined locations. For example, a first material having a first strength is injected into the cavity to make up certain portions of the head, while a second material having a second strength is injected or otherwise disposed into the cavity to make up other portions of the head. The first material and the second material have different strengths. The second material has a greater strength than the first material. By way of example, the first material can consist of a polymeric material such as a nylon plastic, such as nylon 6,6. However, other polymeric, non-polymeric or composite materials may also be utilized. Additionally, the second material, which has greater strength to reinforce certain areas of the lacrosse head can consist of, mineral filled nylons, glass filled nylons, PBT (polybutylene terephthalate), polycarbonate (filled or unfilled), polypropylene (filled), and graphite. However, other polymeric, non-polymeric and composite materials may be utilized. It will be understood that the head can be constructed of more than two different materials as desired.

In accordance with co-molding, the two different materials can be injected into the mold through a single nozzle as will be understood by one of ordinary skill in the art. Alternatively, the two materials can be injected into the mold cavity through multiple nozzles located in different positions. Additionally, it will also be understood, that one material can be injected into the mold through a nozzle and a second stronger material is injected into or within the first material. It will also be understood that both the first material and the second material could be a polymeric plastic material, which have different mechanical strengths or mechanical characteristics in their cured or otherwise hardened final form. However, it will be understood that a variety of other formation processes can be utilized. For example, compression molding, thermal forming and extrusion can be utilized. Further, gas assist injection molding can also be utilized. Moreover, the head can be formed by more than one of these processes.

It will be understood that the methods of the present invention can yield a variety of different types of lacrosse heads.

Referring now to FIGS. 21-27, a preferred method for introducing and locating the reinforcing member 60 in the lacrosse head 10 as depicted in FIGS. 5-7, for example, is illustrated. A consumable plastic insert 120 that forms a portion of the plastic frame 12 is utilized to ensure that the reinforcing member 60 is properly oriented within a cavity portion 141 of a mold 140 prior to and during the injection molding or other forming process.

As shown herein, the mold 140 is preferably a two-piece mold consisting of a top piece 150 and a bottom piece 142 that close to define a cavity portion 141 that is the size and shape of the frame element 12. In addition, the cavity portion 141 includes additional areas that correspond to the gate/runner 160 and the consumable plastic insert 120.

As one of ordinary skill recognizes, alternatively configured molds may be utilized having a different number of components that form the mold and cavity portion.

Figure 21A:
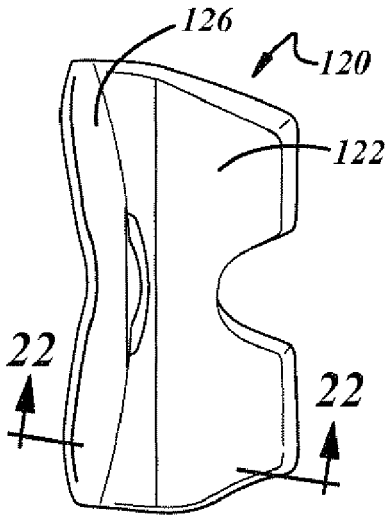
FIG. 21A a front view of an insert piece used for forming the lacrosse head of FIGS. 5-7 according to one preferred embodiment of the present invention.
Figure 21B:
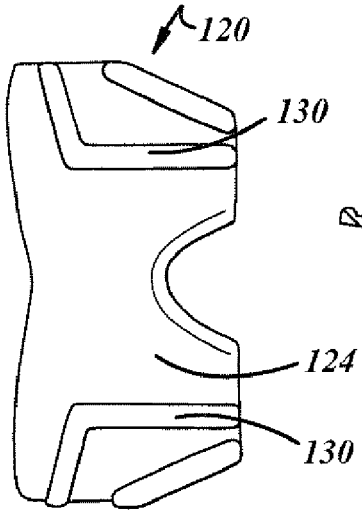
FIG. 21B is a rear view of FIG. 21A.
Figure 22:
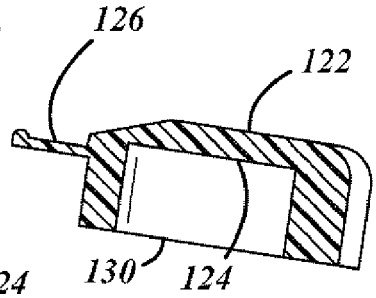
FIG. 22 is a sectional view of FIG. 21A taken along line 22-22.

As best shown in FIGS. 21A, 21B and 22, the consumable plastic insert 120 has a first side 122 and a second side 124. The first side 122 includes a groove 126 that corresponds in size and shape to the middle portion 128 of the reinforcing member 60 that forms a portion of the ball stop portion 14. The second side 124 includes a pair of raised regions 130 that correspond in size and shape to a pair of standoffs 144 located on the bottom piece 142 of the two-piece mold 140.

Figure 23A:
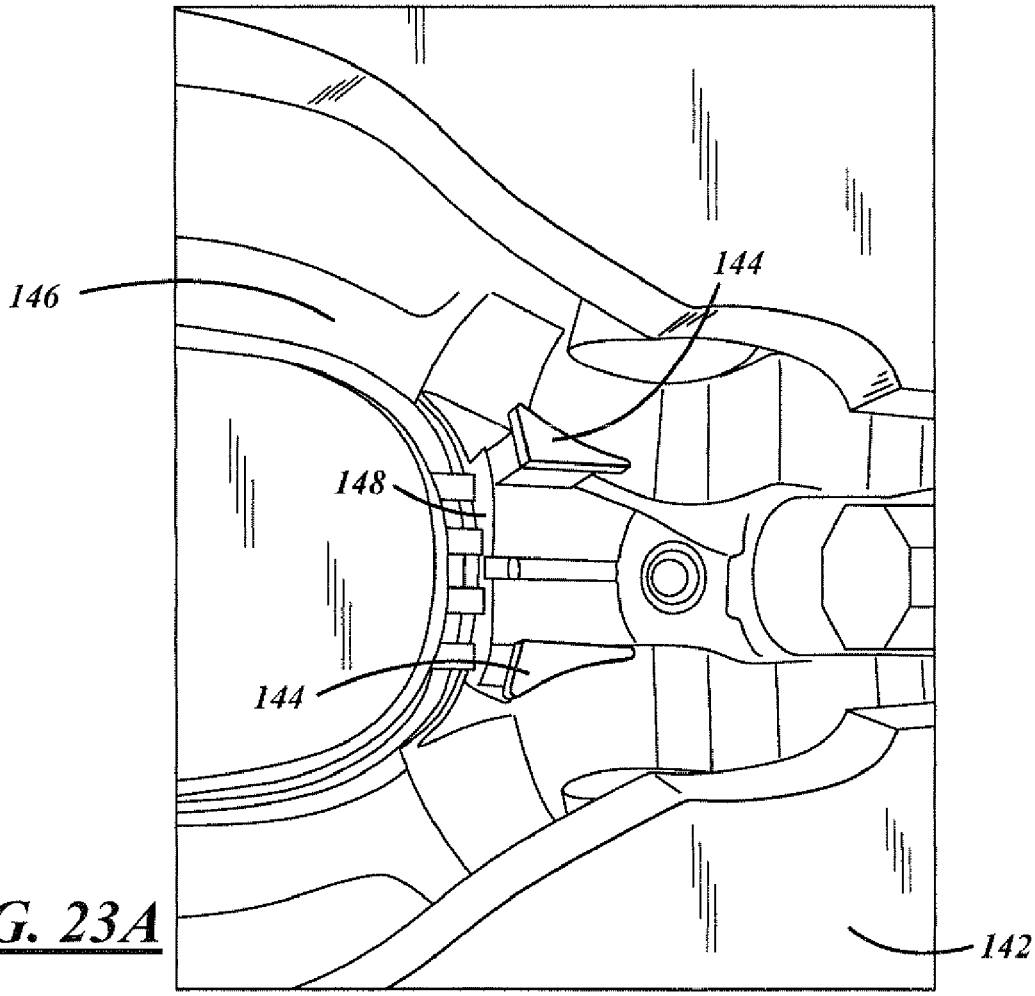
FIG. 23A is a front view of a rear portion of a mold used to form the lacrosse head of FIGS. 5-7 using the insert piece of FIGS. 21 and 22 prior to introduction of the insert piece onto the rear portion of the mold.

Referring now to FIG. 23A, the bottom piece 142 of the two-piece mold 140 is illustrated as including a bottom portion 146 of the cavity portion 141 corresponding in size and shape to a corresponding portion of the frame element 12. The pair of standoffs 144 are located on a lower portion 148 of the bottom portion 146 in a location that corresponds to the ball stop portion 14 of the head 10. As shown in FIG. 23C, two more pair of standoffs 147 and 149 are located adjacent to the bottom portion 146 corresponding to the opposing end portions 62, 64.

Figure 23B:
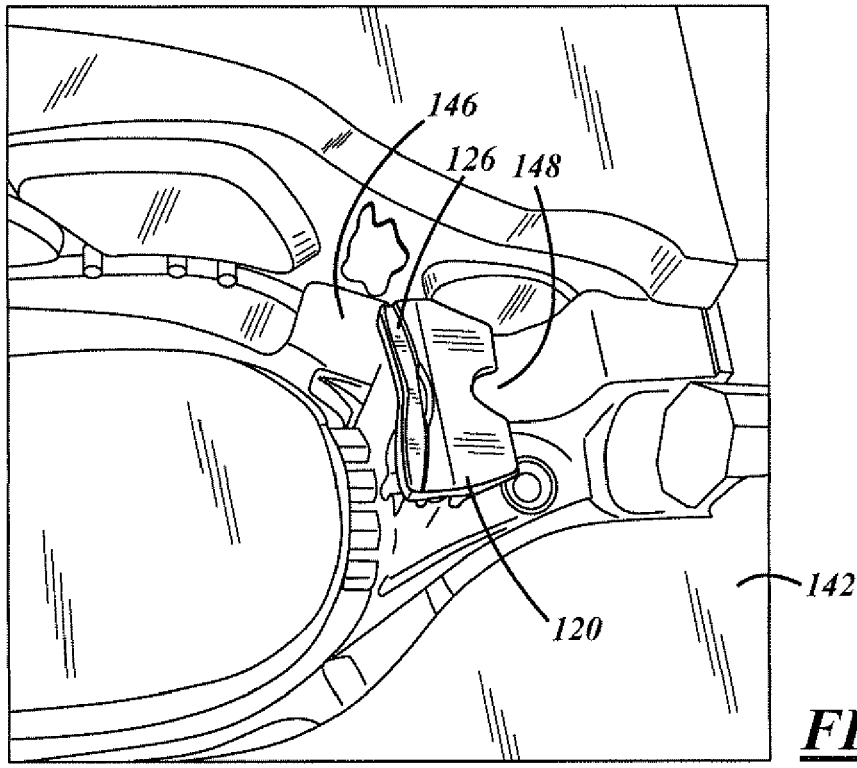
FIG. 23B is a front view of a rear portion of a mold used to form the lacrosse head of FIGS. 5-7 using the insert piece of FIGS. 21 and 22 after the introduction of the insert piece onto the rear portion of the mold.
Figure 23C:
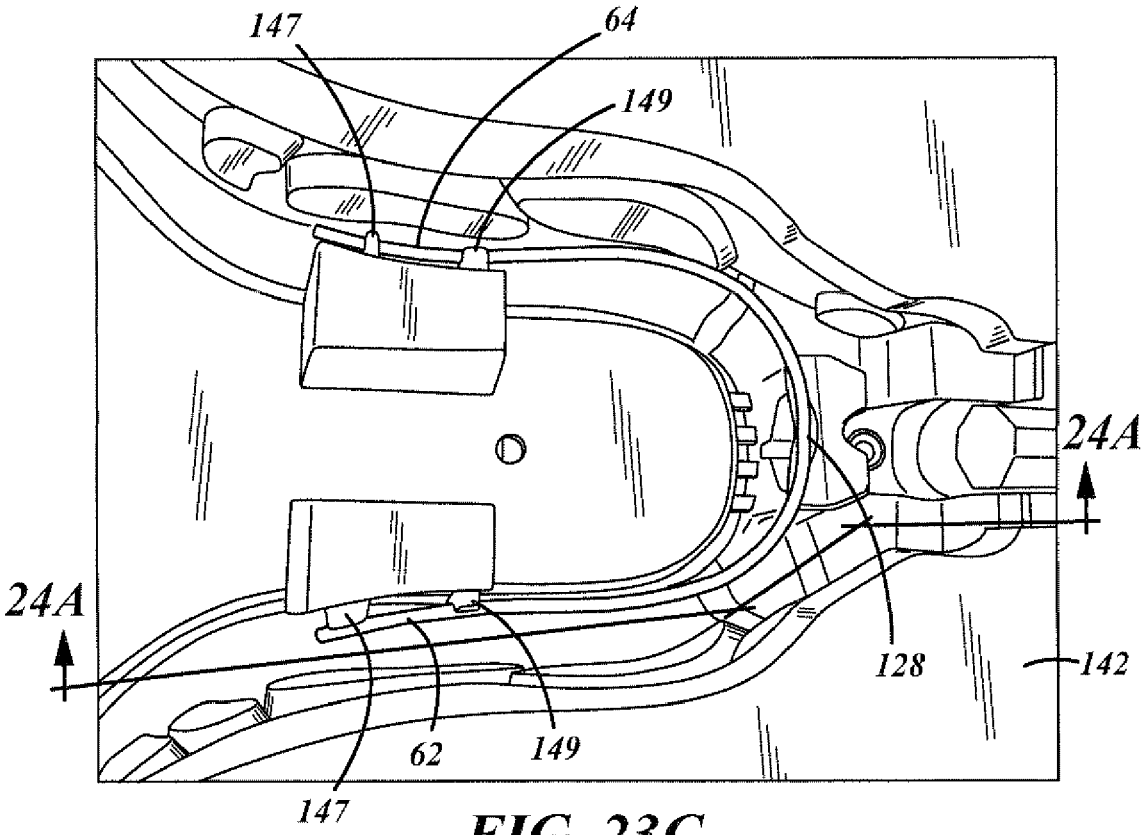
FIG. 23C is a front view of a rear portion of a mold used to form the lacrosse head of FIGS. 5-7 using the insert piece of FIGS. 21 and 22 and the reinforcement member of FIGS. 9 and 10 after the introduction of the insert piece onto the rear portion of the mold and after the introduction of the reinforcement member onto the insert piece.
Figure 24A:
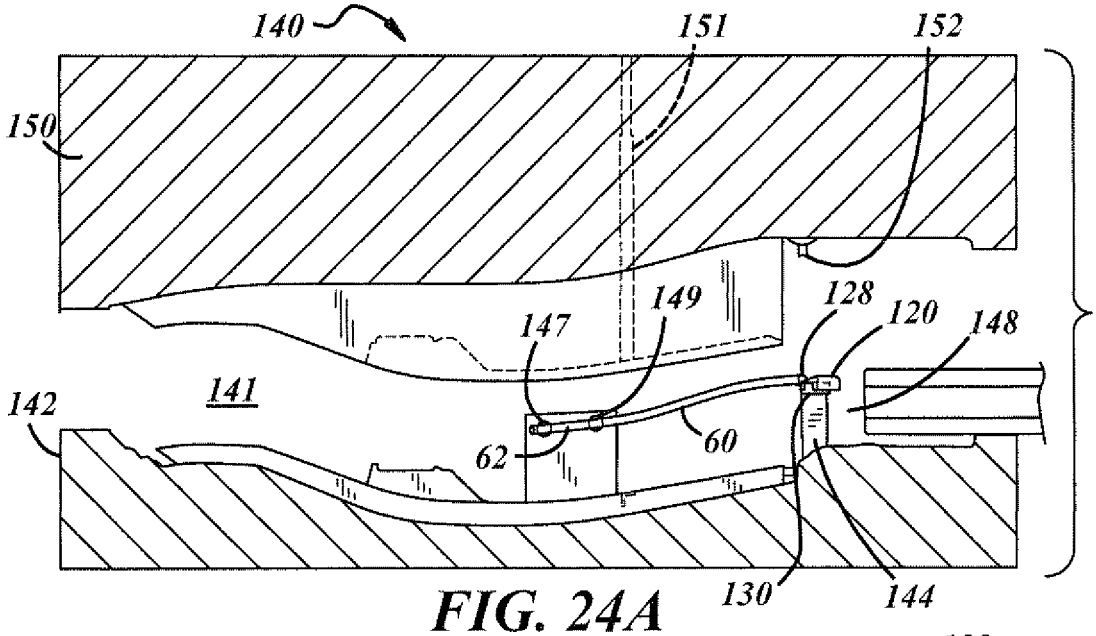
FIG. 24A is a section view of a portion of FIG. 23C taken along line 24A-24A wherein the mold is in an open position.
Figure 24B:
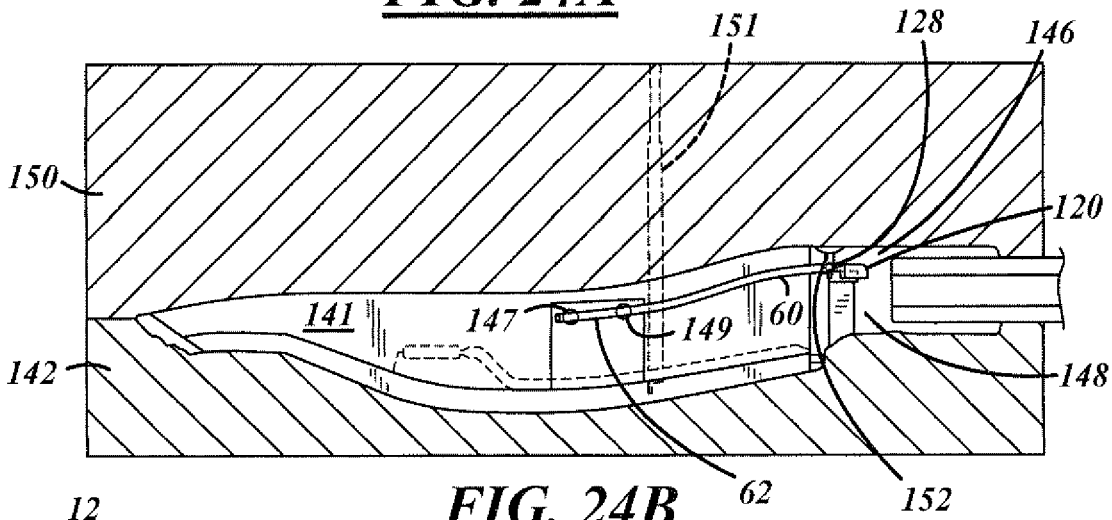
FIG. 24B is a section view of a portion of FIG. 23C taken along line 24A-24A wherein the mold is in a closed position.

As shown in FIGS. 23B, 24A and 24B, the consumable plastic insert 120 is coupled to the bottom piece 142 of the two-piece mold 140 by introducing the raised regions 130 onto the standoffs 144.

Next, as shown in FIG. 23C and in FIG. 24A, the reinforcement member 60 is coupled within the groove 126 and the opposing end portions 62, 64 coupled within the pair of standoffs 147, 149 (i.e. clipped within the standoffs 147, 149). The reinforcement member 60 is thus properly located within the bottom portion 146 of the bottom piece 142 of the two-piece mold 140 corresponding to the subsequently formed portion of the head 10 adjacent to the upper rims 34 of the sidewall portions 16, 18 and the upper rim 30 of the ballstop portion 14.

Figure 25:
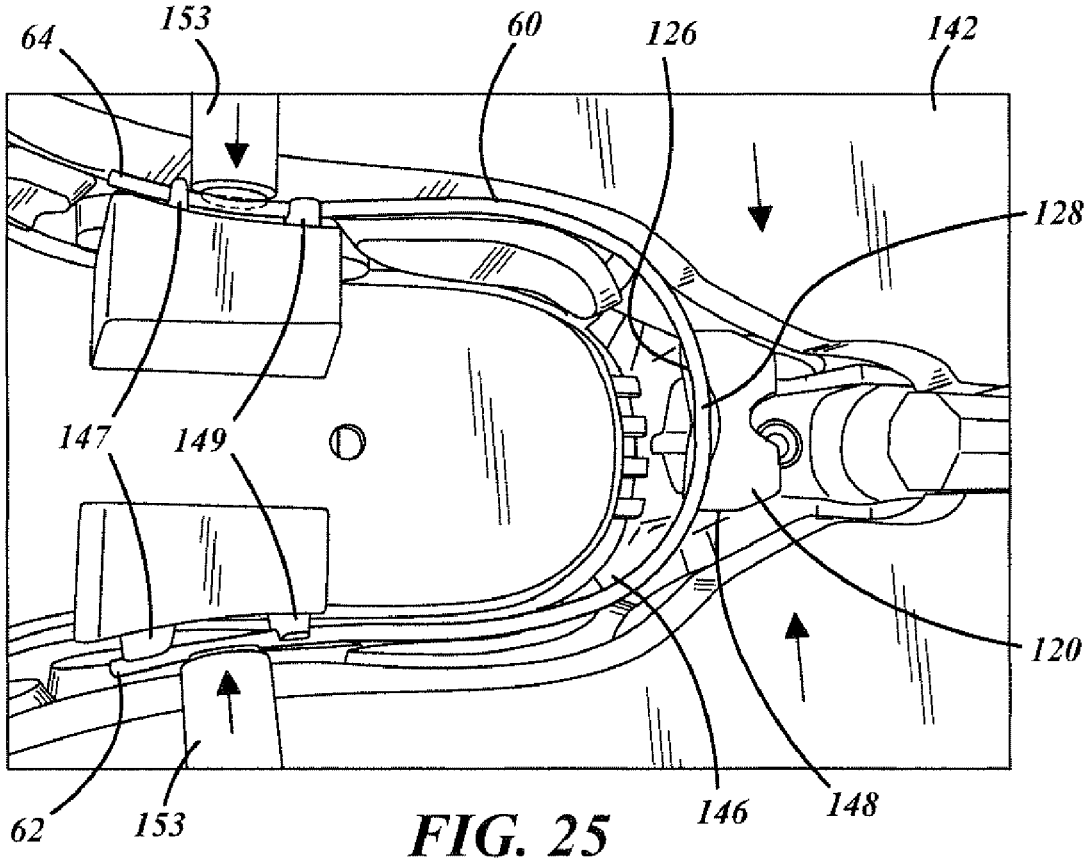
FIG. 25 is a side view of the front portion and rear portion of the mold of FIG. 24 prior to closing.

Next, as shown in FIG. 24B, the top piece 150 of the two-piece mold 140 is closed down onto the bottom piece 142. As this occurs, a coreout 152 on the top piece 150 of the two-piece mold 140 presses the reinforcement member 60 against the groove 26, thus clamping it in place for the subsequent injection cycle. The coreout 152 also prevents the plastic, during the molding process, from covering the window that exposes the reinforcement member 60. Moreover, as shown in FIG. 25, a second pair of coreouts 153 press the end portions 62, 64 of the reinforcement member 60 against their respective pair of standoffs 147, 149. The coreouts 153 also prevents the plastic, during the molding process, from covering the window that exposes the reinforcement member 60. In one embodiment, molten plastic material of the same composition as the consumable plastic insert 120 is then injected through one or more injection ports (representative injection port 151 is shown in the top piece 150) within the cavity portion 141 of the closed mold by conventional invention molding techniques or by gas-assist injection molding.

Figure 26:
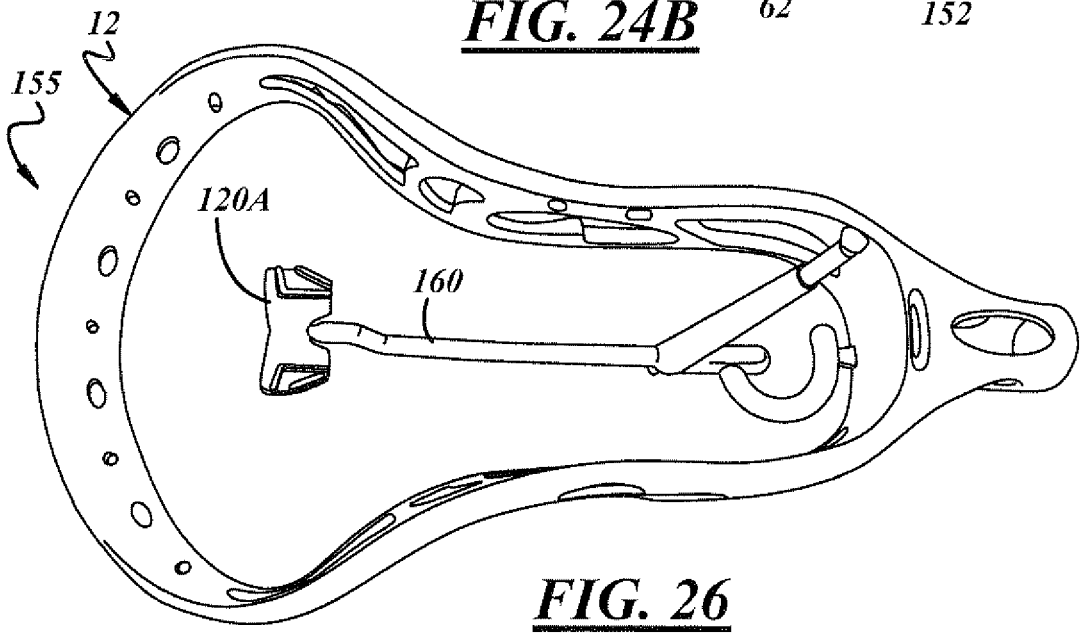
FIG. 26 is a perspective view of the molded part formed by the molding process disclosed in FIGS. 21 through 24.

The molten plastic material causes the consumable plastic insert 120 to melt and become integrated with the injected molten plastic material. The molten plastic material is then allowed to harden with the reinforcement member 60 still properly positioned within the cavity portion 141. The two-piece mold 140 is then opened to eject the hardened plastic piece 155, which includes the frame element 12, the gate/runner 160 and an additional consumable plastic insert 120A, as shown in FIG. 26. The gate/runner 160 and the additional plastic insert 120A, formed during the molding process as shown schematically by the dotted lines in FIG. 24B, are then trimmed from the frame element 12. The gate/runner 160 is discarded, while the plastic consumable insert 120A is retained and used to mold the next frame element 12.

Figure 27:
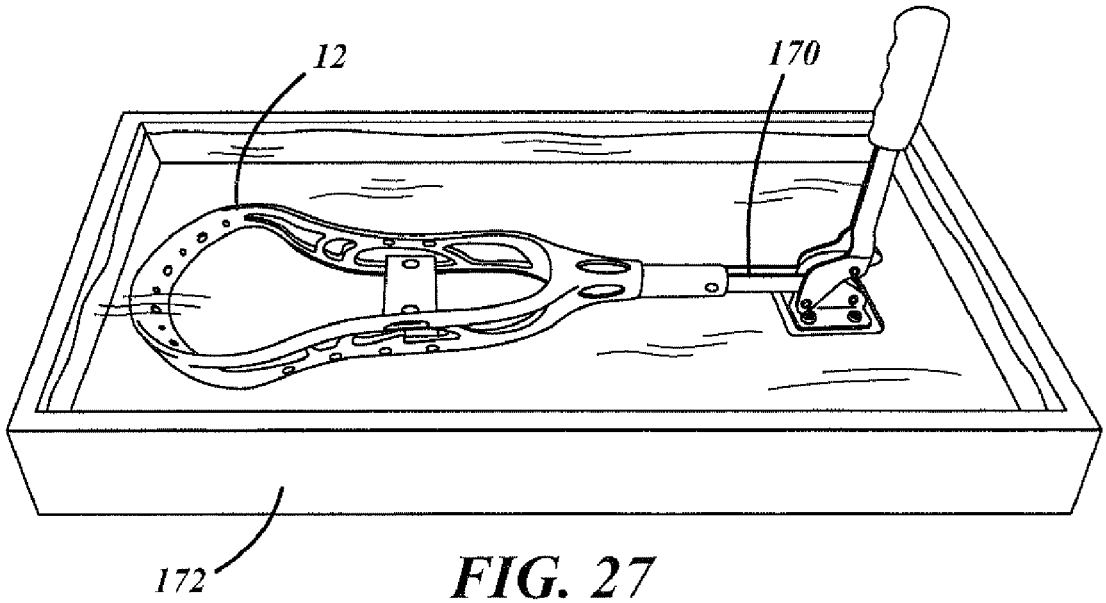
FIG. 27 is a perspective view of a holding fixture and cooling bath used to cool the lacrosse head formed in accordance with the methods illustrated in FIGS. 21-27.

In FIG. 27, the frame element 12 is coupled to a holding fixture 170 that presses up against the lower rim 36. The frame element 12 and holding fixture 170 are lowered into a cooling water bath 172, which cools the frame element 12 to room temperature. The act of pressing the holding fixture 170 against the lower rim 36 prevents uneven shrinkage of the frame element 12 in the water bath 172, as the upper rim 38 containing the reinforcement member 60 would otherwise shrink at a different rate than the portion of the frame element 12 not including the reinforcement member 60 (such as the lower rim 36), which could cause the frame element 12 to warp as it is cooled. After the frame element 12 is cooled sufficiently, it is removed from the water bath 172 and uncoupled from the holding fixture 170.

The frame element 12 is then available for subsequent processing necessary to form the lacrosse head 10. For example, a resilient foam padding 33 is typically applied to the ball stop portion 14. Finally, the lacrosse head 10 is coupled to a lacrosse handle to form the lacrosse stick and is available for use.

While particular embodiments of the invention have been shown and described, numerous variations and alternate embodiments will occur to those skilled in the art.

What is claimed is:

1. A method of forming a lacrosse head for attachment to a lacrosse handle, comprising:

determining a configuration for the lacrosse head, which includes an open frame having a ball stop portion, a pair of opposing sidewalls, a scoop, and a throat portion, which is intended to receive a lacrosse handle;

selecting a plastic material for the lacrosse head;

selecting a generally predetermined location in said open frame for at least one reinforcement member to be disposed that is formed of a second non-plastic material;

providing a mold having a first portion and a second portion which define a cavity therein when said first portion and said second portion are brought together, said cavity being in the shape of the lacrosse head;

providing a consumable insert of said plastic material;

coupling said consumable insert to said cavity;

coupling said at least one reinforcement member to said consumable insert;

injecting molten plastic into said cavity such that said consumable insert is subsumed and become part of the lacrosse head and wherein said at least one reinforcement member is disposed in the lacrosse head in said generally predetermined location.

2. The method of claim 1, wherein said at least one reinforcement member is formed of a metal material.

3. The method of claim 2, wherein said second material is titanium.

4. The method of claim 1, wherein said cavity includes a portion to allow formation of at least one other consumable insert for use in subsequent molding processes.

5. The method of claim 1, wherein said consumable insert includes a groove for receiving and retaining said at least one reinforcement member.

6. The method of claim 1, wherein said consumable insert is disposed in said cavity such that it is subsumed generally in said throat portion of the lacrosse head.

7. The method of claim 1, wherein a plurality of inserts are located at different locations in said cavity to retain said at least one reinforcement member.

8. The method of claim 7, wherein one of said plurality of inserts is disposed in said cavity such that it is subsumed generally in a respective one of said sidewalls.

* * * * *

UNITED STATES PATENT AND TRADEMARK OFFICE

CERTIFICATE OF CORRECTION

PATENT NO. : 7,749,113 B2
APPLICATION NO. : 11/753959
DATED : July 6, 2010
INVENTOR(S) : Morrow et al.

It is certified that error appears in the above-identified patent and that said Letters Patent is hereby corrected as shown below:

Title Page

Related U.S. Application Data

"(63) Continuation-in-part of application No. 10/437,842, filed on May 14, 2003, now Pat. No. 7,258,634, and a continuation-in-part of application No. 10/437,542, filed on May 14, 2003, now Pat. No. 7,226,374."

should be

--(63) Continuation-in-part of application No. 10/437,842, filed on May 14, 2003, now Pat. No. 7,258,634, and a continuation-in-part of application No. 10/437,542, filed on May 14, 2003, now Pat. No. 7,226,374

(60) Provisional application No. 60/380,547, filed May 14, 2002, provisional application No. 60/418,922, filed October 15, 2002--

Signed and Sealed this
First Day of March, 2011

David J. Kappos

David J. Kappos
*Director of the United States Patent and Trademark Office*